US007739988B2

(12) United States Patent
Mashiki et al.

(10) Patent No.: US 7,739,988 B2
(45) Date of Patent: Jun. 22, 2010

(54) VARIABLE VALVE TIMING SYSTEM AND METHOD FOR CONTROLLING THE SAME

(75) Inventors: Zenichiro Mashiki, Nissin (JP); Yasumichi Inoue, Toyota (JP); Haruyuki Urushihata, Chiryu (JP)

(73) Assignees: Toyota Jidosha Kabushiki Kaisha, Toyota-shi (JP); Denso Corporation, Kariya (JP)

( * ) Notice: Subject to any disclaimer, the term of this patent is extended or adjusted under 35 U.S.C. 154(b) by 147 days.

(21) Appl. No.: 11/846,793

(22) Filed: Aug. 29, 2007

(65) Prior Publication Data

US 2008/0053269 A1 Mar. 6, 2008

(30) Foreign Application Priority Data

Aug. 31, 2006 (JP) ..... 2006-235909

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2006/0106527 A1* 5/2006 Miyakoshi et al. ..... 701/114

FOREIGN PATENT DOCUMENTS

| | | |
|---|---|---|
| JP | 4-246249 | 9/1992 |
| JP | 2002-349301 | 12/2002 |
| JP | 2004-156461 | 6/2004 |
| JP | 2005-120874 | 5/2005 |

OTHER PUBLICATIONS

Machine Translation of JP2002-349301.*

* cited by examiner

*Primary Examiner*—Zelalem Eshete
(74) *Attorney, Agent, or Firm*—Oblon, Spivak, McClelland, Maier & Neustadt, L.L.P.

(57) ABSTRACT

An intake valve phase setting unit sets the target valve phase used in the variable valve timing control based on the engine operating state, and a control target value setting unit sets the control target value based on the target valve phase. An actuator operation amount setting unit prepares the rotational speed command value for an electric motor that serves as an actuator of a variable valve timing system based on the deviation of the current value from the control target value. A phase change rate control unit sets the rate of change in the valve phase to a lower value when the variable valve timing control moves the valve phase away from the reference phase (the phase when the engine is idling) at which combustion takes place stably in engine than when the variable valve timing control causes the valve phase to the reference phase.

12 Claims, 15 Drawing Sheets

VARIABLE VALVE TIMING SYSTEM AND METHOD FOR CONTROLLING THE SAME

The disclosure of Japanese Patent Application No. 2006-235909 filed on Aug. 31, 2006 including the specification, drawings and abstract is incorporated herein by reference in its entirety.

BACKGROUND OF THE INVENTION

1. Field of the Invention

The invention relates generally to a variable valve timing system and a method for controlling the same, and, more specifically, to a variable valve timing system that is provided with a mechanism which changes opening/closing timing of a valve by an amount of change corresponding to an operation amount of an actuator, and a method for controlling the same.

2. Description of the Related Art

A variable valve timing (VVT) system that changes the phase (i.e., crank angle), at which an intake valve or an exhaust valve is opened/closed, based on the engine operating state has been used. Such variable valve timing system changes the phase of the intake valve or the exhaust valve by rotating a camshaft, which opens/closes the intake valve or the exhaust valve, relative to, for example, a sprocket. The camshaft is rotated hydraulically or by means of an actuator, for example, an electric motor.

For example, Japanese Patent Application Publication No. JP-A-2005-120874 (JP-A-2005-120874) describes a valve timing adjustment device that adjusts the valve timing of a valve provided in an engine using a rotary torque produced by an electric motor. The valve timing adjustment device sets a target amount of change in the rotational speed of the electric motor based on the deviation of the actual phase, which is determined based on the rotational speed of a crankshaft and the rotational speed of a camshaft, from the target phase set based on the operating state of the engine. The target amount of change corresponds to the rate of phase change, and the electricity passing through the electric motor is controlled by a drive circuit that receives a control signal indicating the target amount of change in the rotational speed of the electric motor.

The valve timing of a valve provided in an engine exerts a great influence on the combustion stability, the fuel efficiency, the power output from the engine, exhaust emission, etc. Namely, the target phase of the valve timing varies depending on which of the above-mentioned elements is given a priority. For example, when the engine is idling, the target phase at which a priority is given to the combustion stability is set.

Generally, the target phase is set in advance based on the operating state of the engine such that the above-mentioned elements are collectively realized in a balanced manner. More specifically, while the engine is operating, the target phase of the valve timing is successively set in accordance with a change in the operating state of the engine with reference to, for example, a map that stores the correlation between the engine operating state and the target phase in advance.

Accordingly, during the valve timing control, a valve timing change that reduces the combustion stability is sometimes made. Therefore, it is important to take the correlation between the direction in which the valve timing is changed and the combustion stability into account in order to execute the valve timing control to improve the total engine performance as described above. When the phase at which the combustion stability is high is present in the middle of the control range in which the phase of the valve timing is changed, the rate of phase change is changed depending on whether the phase is advanced or delayed. In addition to this, the control should be executed with the correlation between the direction in which the valve timing is changed and the combustion stability taken into account.

SUMMARY OF THE INVENTION

The invention provides a variable valve timing system that executes a valve timing control based on the engine operating state without reducing the combustion stability, and a method for controlling the same.

A first aspect of the invention relates to a variable valve timing system that changes opening/closing timing of at least one of an intake valve and an exhaust valve provided in an engine, and that includes a changing mechanism, a target phase setting unit, a control target value setting unit, an actuator operation amount setting unit, a phase change direction determination unit, and a change rate control unit. The changing mechanism is configured to change the opening/closing timing of at least one of the intake valve and the exhaust valve by an amount of change corresponding to the operation amount of an actuator; and configured such that the reference timing at which combustion takes place stably in the engine is present in the middle of the control range in which the opening/closing timing is changed. The target phase setting unit sets the target opening/closing timing of at least one of the intake valve and the exhaust valve based on the operating state of the engine. The control target value setting unit sets the control target value of the opening/closing timing based on the target opening/closing timing set by the target phase setting unit. The actuator operation amount setting unit sets the operation amount of the actuator based on the deviation of the current value of the opening/closing timing from the control target value. The phase change direction determination unit determines, based on the current value of the opening/closing timing and the target opening/closing timing, whether the direction of a change in the opening/closing timing is the first direction in which the opening/closing timing approaches the reference timing or the second direction in which the opening/closing timing moves away from the reference timing. The change rate control unit sets the rate of change in the opening/closing timing to a lower value when the opening/closing timing changes in the second direction than when the opening/closing timing changes in the first direction.

In the first aspect of the invention, the reference timing may be substantially the same as the target opening/closing timing that is set when the engine is idling.

With the variable valve timing system described above, when the direction of a change in the opening/closing timing, which is caused by executing the valve opening/closing timing control based on the engine operating state, is the direction in which the valve phase moves away from the reference timing, namely, in the direction in which the combustion stability in the engine is reduced, the control is executed such that restriction is placed on the rate of change in the opening/closing timing with respect to a change in the target opening/closing timing based on the engine operating state. Thus, it is possible to prevent a negative influence on the combustion stability in the engine due to the valve opening/closing timing control. On the other hand, when the direction of a change in the opening/closing timing, which is caused by executing the valve opening/closing timing control, is the direction in which the valve phase approaches the reference timing, namely, in the direction in which the combustion stability in the engine is enhanced, the control is executed such that a sufficient rate of change in the opening/closing timing with respect to a change in the target opening/closing timing is maintained and the total engine performance is enhanced by achieving the effects of the valve opening/closing timing control. Thus, it is possible to execute the valve opening/closing timing control based on the engine operating state without reducing the combustion stability.

In the first aspect of the invention, the control target value setting unit may be configured to set the control target value by smoothing a change in the target opening/closing timing set by the target phase setting unit in the direction of time axis, and the change rate control unit may set the degree, to which the change in the target opening/closing timing is smoothed in the direction of time axis by the control target value setting unit, to a higher value when the opening/closing timing changes in the second direction than when the opening/closing timing changes in the first direction.

With this configuration, when a time-change in the target opening/closing timing set based on the engine operating state is reflected on the control target value used in the valve opening/closing control, the degree to which the change in the target opening/closing timing is smoothed in the direction of time axis is variably set. In this way, the valve opening/closing timing control is executed without reducing the combustion stability.

In the first aspect of the invention, the actuator operation amount setting unit may set the operation amount of the actuator to a value equal to or smaller than the maximum control amount within a single control cycle based on the deviation of the current value of the opening/closing timing from the control target value, and the change rate control unit may set the maximum control amount to a smaller value when the opening/closing timing changes in the second direction than when the opening/closing timing changes in the first direction.

With this configuration, the maximum control amount within a single control cycle of the valve opening/closing timing control is variably set. In this way, the valve opening/closing timing control is executed without reducing the combustion stability.

In the first aspect of the invention, an electric motor may be used as the actuator, and the operation amount of the actuator may be the rotational speed of the electric motor relative to the rotational speed of a camshaft that drives the valve of which the opening/closing timing is changed. The control range in which the opening/closing timing is changed may include the first region and the second region, and the reference timing may be set within the first region. The changing mechanism may be configured such that the ratio of the amount of change in the opening/closing timing with respect to the operation amount of the actuator is set to a higher value when the opening/closing timing is within the first region than when the opening/closing timing is within the second region, and configured such that the opening/closing timing outside the first region is changed so as to be brought into the first region when the rotational speed of the electric motor is lower than the rotational speed of the camshaft.

With this configuration, when the electric motor that serves as the actuator becomes inoperative while the engine is operating, if the opening/closing timing is within the first region, namely, at the phase relatively close to the reference timing, the amount of change in the opening/closing timing is restricted. If the opening/closing timing is within the second region, namely, at the phase relatively distant from the reference phase, the opening timing is changed so as to be brought into the proximity of the reference timing (the first region). Accordingly, even if the valve opening/closing timing control becomes inexecutable due to a malfunction in the actuator while the engine is operating, the opening/closing timing is set to timing at which the combustion takes place stably in the engine.

A second aspect of the invention relates to a method for controlling a variable valve timing system that changes opening/closing timing of at least one of an intake valve and an exhaust valve provided in an engine, and that includes a changing mechanism that is configured to change the opening/closing timing of at least one of the intake valve and the exhaust valve by an amount of change corresponding to the operation amount of an actuator; and configured such that the reference timing at which combustion takes place stably in the engine is present in the middle of the control range in which the opening/closing timing is changed. According to the method, the target opening/closing timing of at least one of the intake valve and the exhaust valve is set based on the operating state of the engine, and the control target value of the opening/closing timing is set based on the target opening/closing timing that is set based on the operating state of the engine. The operation amount of the actuator is set based on the deviation of the current value of the opening/closing timing from the control target value. Based on the current value of the opening/closing timing and the target opening/closing timing, it is determined whether the direction of a change in the opening/closing timing is the first direction in which the opening/closing timing approaches the reference timing or the second direction in which the opening/closing timing moves away from the reference timing. Then, the rate of change in the opening/closing timing is set to a lower value when the opening/closing timing changes in the second direction than when the opening/closing timing changes in the first direction.

With the variable valve timing system and the method for controlling the variable valve timing system according to the aspects of the invention described above, the valve timing control is executed based on the engine operating state without reducing the combustion stability.

BRIEF DESCRIPTION OF THE DRAWINGS

The foregoing and further objects, features and advantages of the invention will become apparent from the following description of an embodiment with reference to the accompanying drawings, wherein the same or corresponding elements will be denoted by the same reference numerals and wherein.

DETAILED DESCRIPTION OF THE EMBODIMENT

Figure 1:
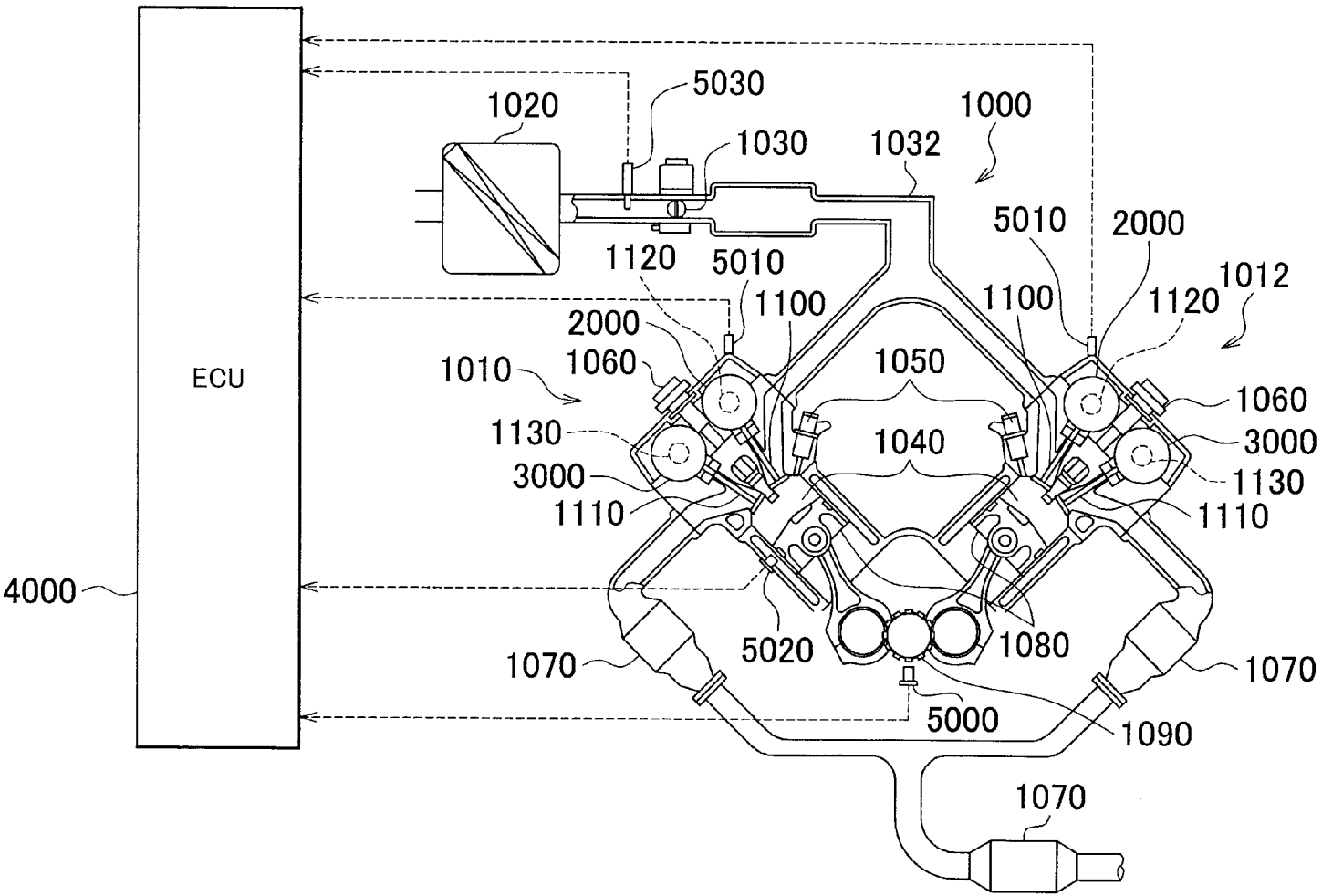
FIG. 1 is a view schematically showing the structure of a vehicle engine provided with a variable valve timing system according to an embodiment of the invention.

Hereafter, an embodiment of the invention will be described with reference to the accompanying drawings. In the following description, the same or corresponding elements will be denoted by the same reference numerals. The names and functions of the elements having the same reference numerals are also the same. Accordingly, the descriptions concerning the elements having the same reference numerals will be provided only once below.

First, a vehicle engine provided with a variable valve timing system according to the embodiment of the invention will be described with reference to FIG. 1.

An engine 1000 is an eight-cylinder V-type engine including a first bank 1010 and a second bank 1012 each of which has four cylinders therein. Note that, the variable valve timing system according to the embodiment of the invention may be applied to any types of engines. Namely, the variable valve timing system may be applied to engines other than an eight-cylinder V-type engine.

Air that has passed through an air cleaner 1020 is supplied to the engine 1000. A throttle valve 1030 adjusts the amount of air supplied to the engine 1000. The throttle valve 1030 is an electronically-controlled throttle valve that is driven by a motor.

The air is introduced into a cylinder 1040 through an intake passage 1032. The air is then mixed with fuel in a combustion chamber formed within the cylinder 1040. The fuel is injected from an injector 1050 directly into the cylinder 1040. Namely, the injection hole of the injector 1050 is positioned within the cylinder 1040.

The fuel is injected into the cylinder 1040 in the intake stroke. The time at which the fuel is injected need not be in the intake stroke. The description concerning the embodiment of the invention will be provided on the assumption that the engine 1000 is a direct-injection engine where the injection hole of the injector 1050 is positioned within the cylinder 1040. In addition to the injector 1050 for direct-injection, an injector for port-injection may be provided. Alternatively, only an injector for port-injection may be provided.

The air-fuel mixture in the cylinder 1040 is ignited by a spark plug 1060, and then burned. The burned air-fuel mixture, namely, the exhaust gas is purified by a three-way catalyst 1070, and then discharged to the outside of the vehicle. A piston 1080 is pushed down due to combustion of the air-fuel mixture, whereby a crankshaft 1090 is rotated.

An intake valve 1100 and an exhaust valve 1110 are provided on the top of the cylinder 1040. The intake valve 1100 is driven by an intake camshaft 1120, and the exhaust valve 1110 is driven by an exhaust camshaft 1130. The intake camshaft 1120 and the exhaust camshaft 1130 are connected to each other by, for example, a chain or a gear, and rotate at the same number of revolutions (at one-half the number of revolutions of the crankshaft 1090). Because the number of revolutions (typically, the number of revolutions per minute (rpm)) of a rotating body, for example, a shaft is usually referred to as the rotational speed, the term "rotational speed" will be used in the following description.

The phase (opening/closing timing) of the intake valve 1100 is controlled by an intake VVT mechanism 2000 which is fitted to the intake camshaft 1120. The phase (opening/closing timing) of the exhaust valve 1110 is controlled by an exhaust VVT mechanism 3000 which is fitted to the exhaust camshaft 1130.

In the embodiment of the invention, the intake camshaft 1120 and the exhaust camshaft 1130 are rotated by the VVT mechanisms 2000 and 3000, respectively, whereby the phase of the intake valve 1100 and the phase of the exhaust valve 1110 are controlled. However, the method for controlling the phase is not limited to this.

Figure 3:
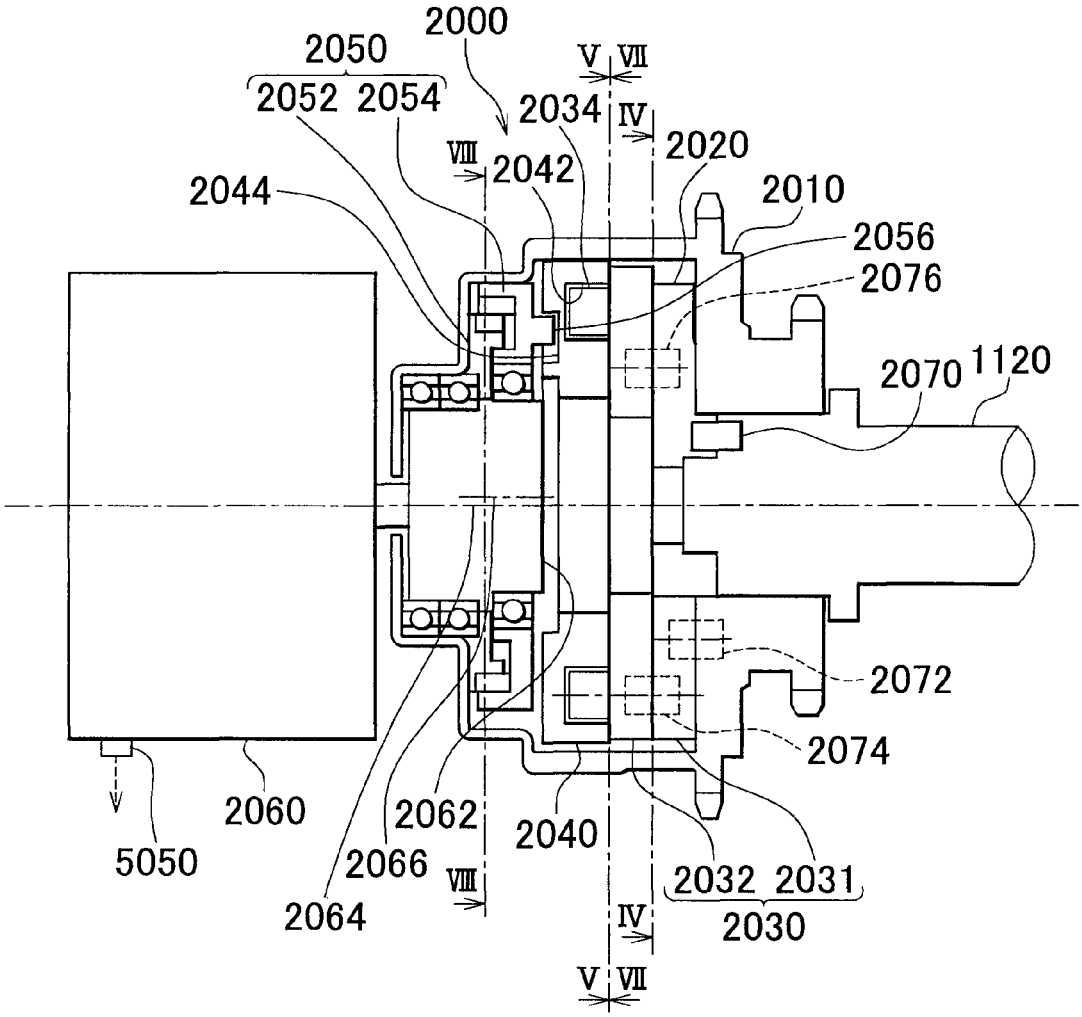
FIG. 3 is a cross-sectional view showing an intake VVT mechanism.

The intake VVT mechanism 2000 is operated by an electric motor 2060 (shown in FIG. 3). The electric motor 2060 is controlled by an electronic control unit (ECU) 4000. The magnitude of electric current passing through the electric motor 2060 is detected by an ammeter (not shown) and the voltage applied to the electric motor 2060 is detected by a voltmeter (not shown), and a signal indicating the magnitude of electric current and a signal indicating the voltage are transmitted to the ECU 4000.

The exhaust VVT mechanism 3000 is hydraulically operated. Note that, the intake VVT mechanism 2000 may be hydraulically operated. Note that, the exhaust VVT mechanism 3000 may be operated by means of an electric motor.

The ECU 4000 receives signals indicating the rotational speed and the crank angle of the crankshaft 1090, from a crank angle sensor 5000. The ECU 4000 also receives a signal indicating the phase of the intake camshaft 1120 and a signal indicating the phase of the exhaust camshaft 1130 (the positions of these camshafts in the rotational direction), from a camshaft position sensor 5010.

In addition, the ECU 4000 receives a signal indicating the temperature of a coolant for the engine 1000 (the coolant temperature) from a coolant temperature sensor 5020, and a signal, indicating the amount of air supplied to the engine 1000, from an airflow meter 5030.

The ECU 4000 controls the throttle valve opening amount, the ignition timing, the fuel injection timing, the fuel injection amount, the phase of the intake valve 1100, the phase of the exhaust valve 1110, etc. based on the signals received from the above-mentioned sensors and the maps and programs stored in memory (not shown) so that the engine 1000 is brought into the desired operating state.

Figure 2:
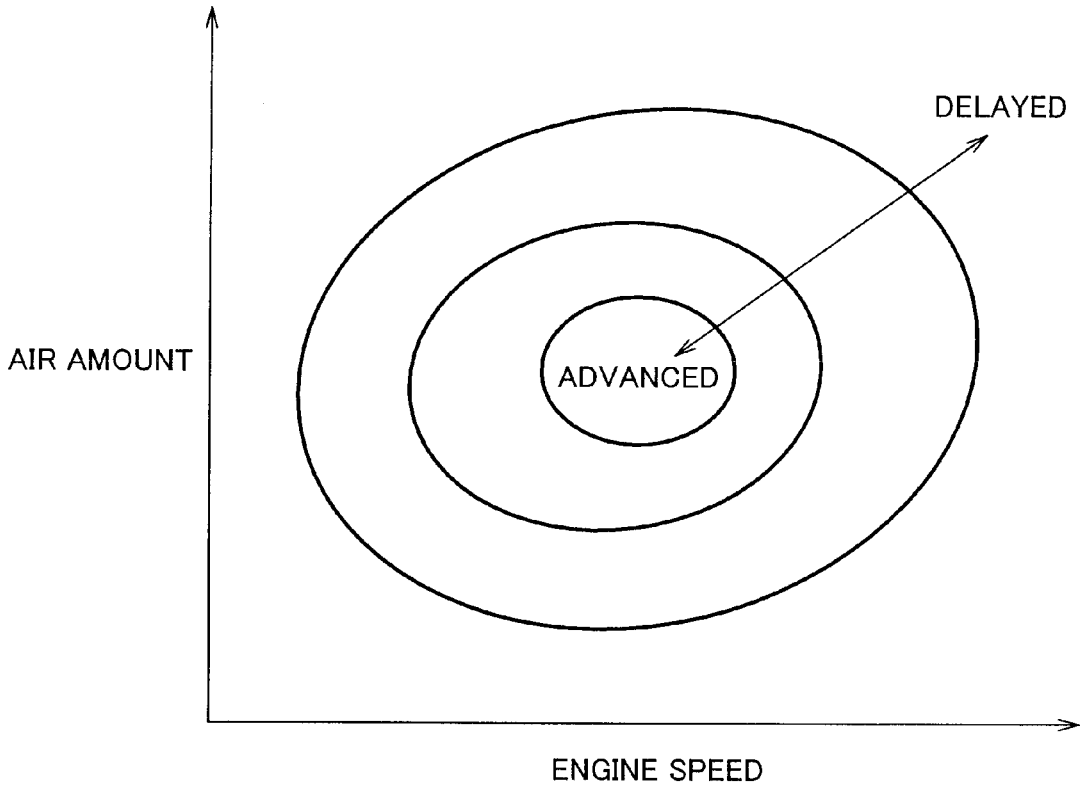
FIG. 2 is a graph showing the map that defines the phase of an intake camshaft.

According to the embodiment of the invention, the ECU 4000 successively sets the target phase of the intake valve 1100 appropriate for the current engine operating state with reference to the map that defines the target phase in advance using parameters indicating the engine operating state, typically, using the engine speed NE and the intake air amount KL, as shown in FIG. 2. Generally, multiple maps, used to set the target phase of the intake valve 1100 at multiple coolant temperatures, are stored.

As described above, the target phase of the intake valve 1100 is set in consideration of which of the combustion stability, the fuel efficiency, the power output from the engine, and the exhaust emission is given a priority in each engine operating state. For example, when the engine is idling, the target phase at which a priority is given to the combustion stability is set. FIG. 2 also shows the qualitative property of the manner in which the target phase is set using the engine speed NE and the intake air amount KL as the parameters.

Hereafter, the intake VVT mechanism 2000 will be described in more detail. Note that, the exhaust VVT mechanism 3000 may have the same structure as the intake VVT mechanism 2000 described below. Alternatively, each of the intake VVT mechanism 2000 and the exhaust VVT mechanism 3000 may have the same structure as the intake VVT mechanism 2000 described below.

As shown in FIG. 3, the intake VVT mechanism 2000 includes a sprocket 2010, a cam plate 2020, link mechanisms 2030, a guide plate 2040, a speed reducer 2050, and the electric motor 2060.

The sprocket 2010 is connected to the crankshaft 1090 via, for example, a chain. The rotational speed of the sprocket 2010 is one-half the rotational speed of the crankshaft 1090, as in the case of the intake camshaft 1120 and the exhaust camshaft 1130. The intake camshaft 1120 is provided such that the intake camshaft 1120 is coaxial with the sprocket 2010 and rotates relative to the sprocket 2010.

The cam plate 2020 is connected to the intake camshaft 1120 with a first pin 2070. In the sprocket 2010, the cam plate 2020 rotates together with the intake camshaft 1120. The cam plate 2020 and the intake camshaft 1120 may be formed integrally with each other.

Figure 4:
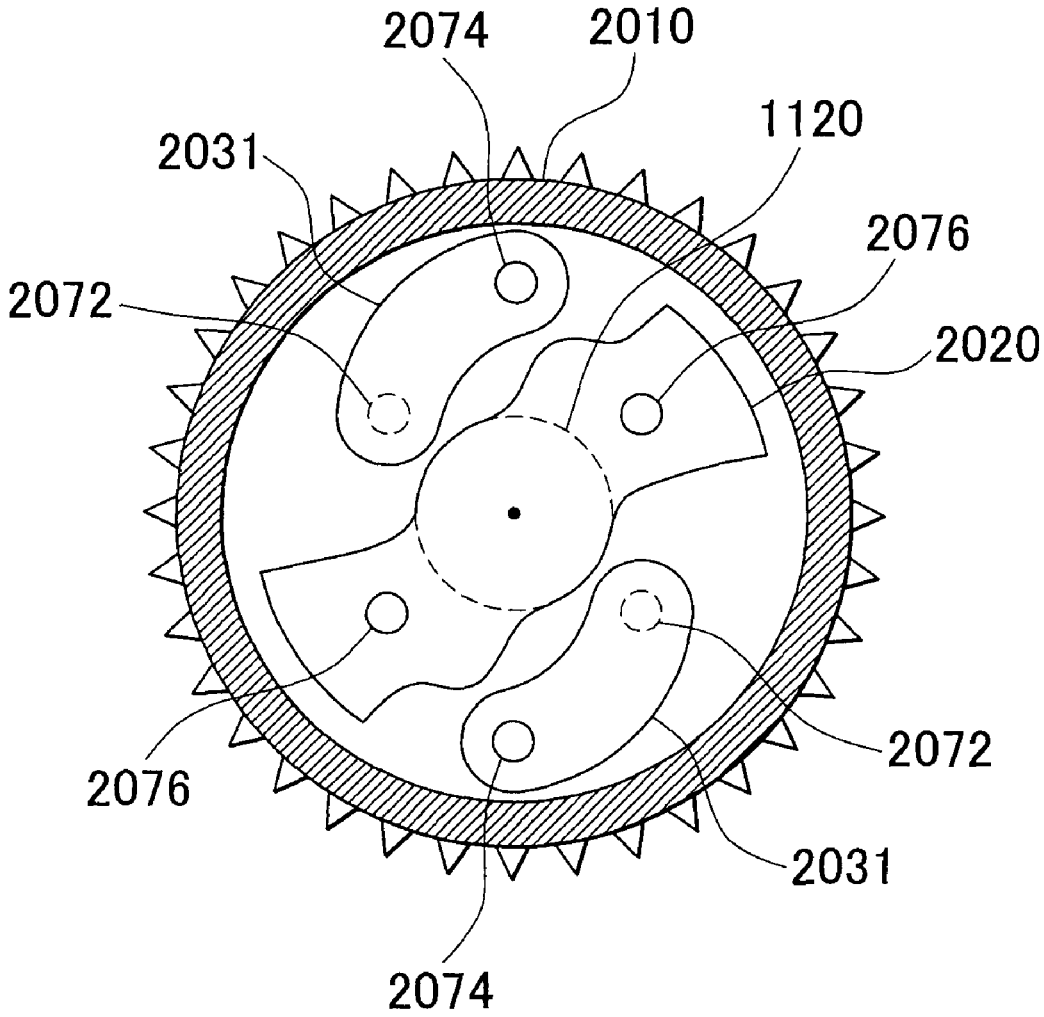
FIG. 4 is a cross-sectional view taken along the line IV-IV in FIG. 3.

Each link mechanism 2030 is formed of a first arm 2031 and a second arm 2032. As shown in FIG. 4, that is, a cross-sectional view taken along the line IV-IV in FIG. 3, paired first arms 2031 are arranged in the sprocket 2010 so as to be symmetric with respect to the axis of the intake camshaft 1120. Each first arm 2031 is connected to the sprocket 2010 so as to pivot about a second pin 2072.

Figure 5:
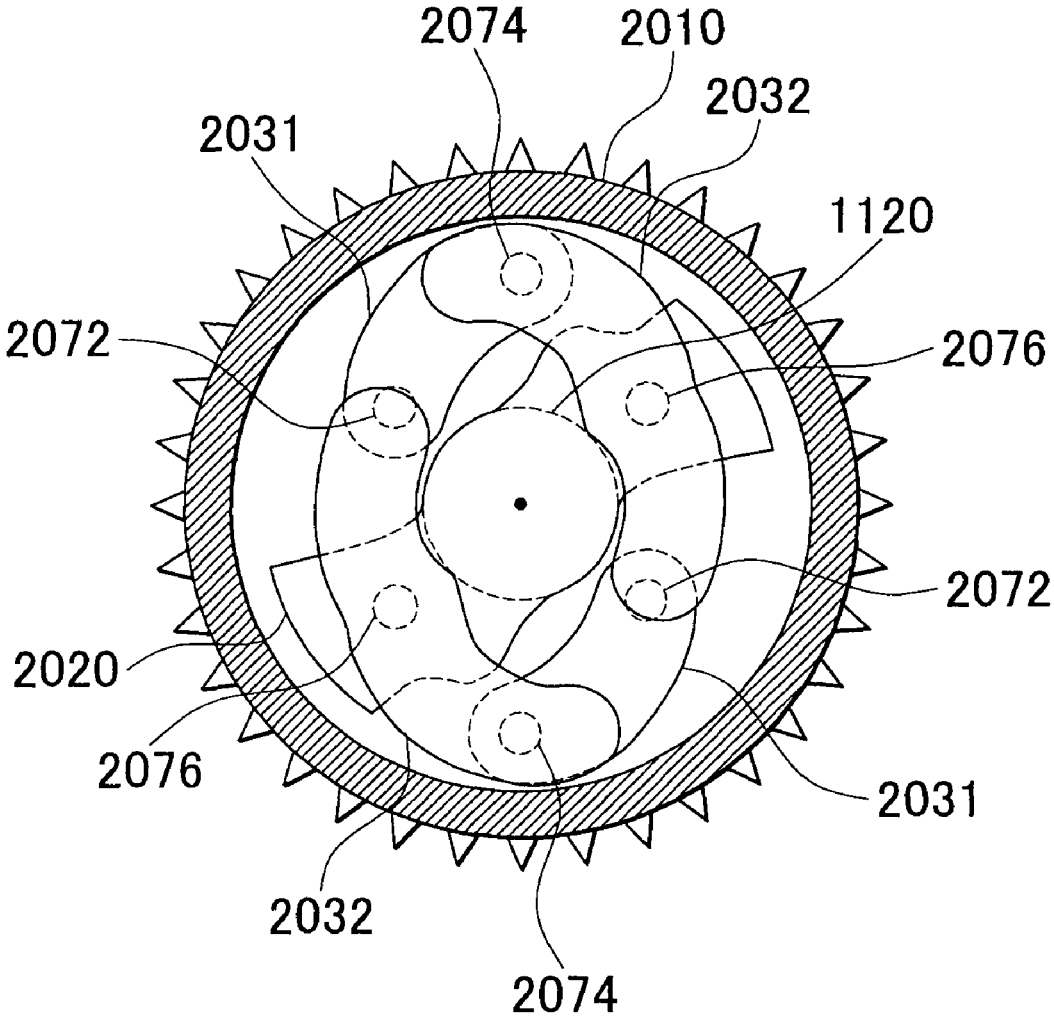
FIG. 5 is a first cross-sectional view taken along the line V-V in FIG. 3.
Figure 6:
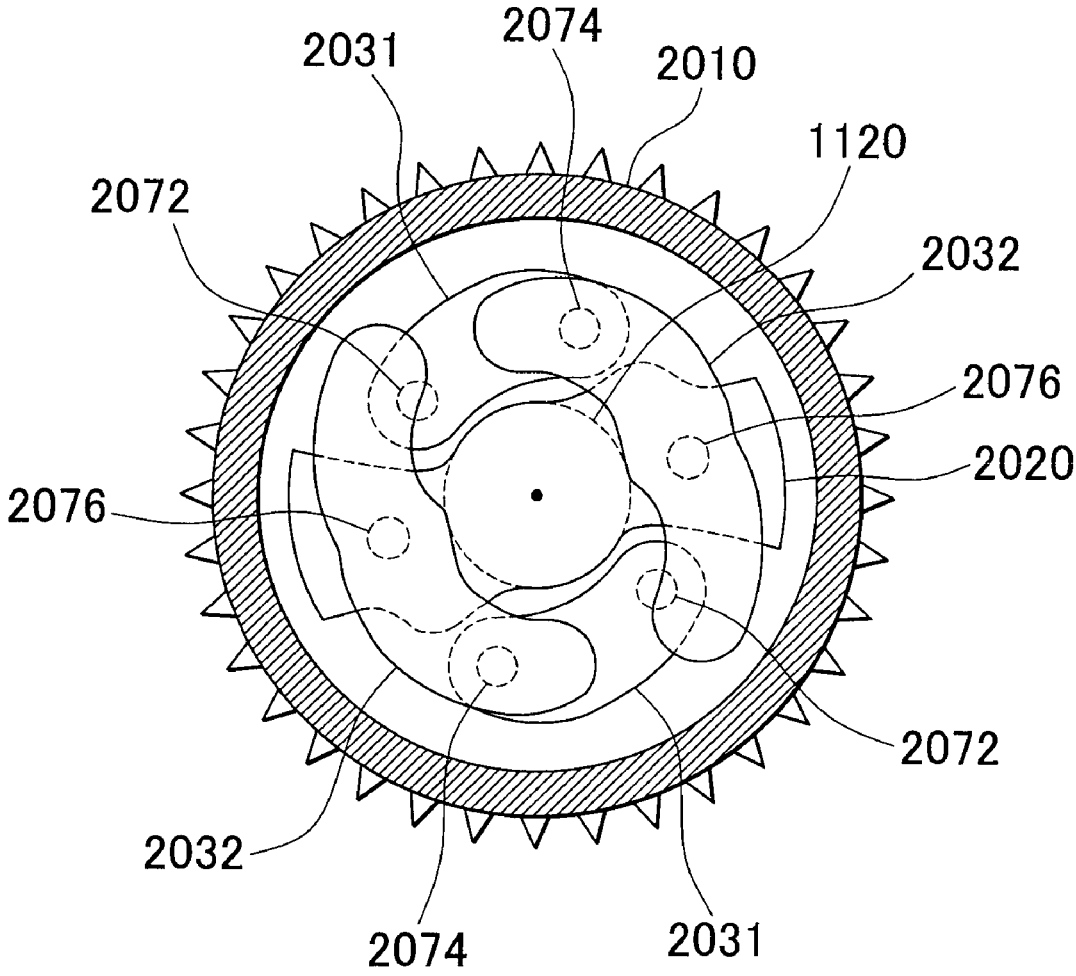
FIG. 6 is a second cross-sectional view taken along the line V-V in FIG. 3.

As shown in FIG. 5, that is, a cross-sectional view taken along the line V-V in FIG. 3, and FIG. 6 that shows the state achieved by advancing the phase of the intake valve 1100 from the state shown in FIG. 5, the first arms 2031 and the cam plate 2020 are connected to each other by the second arms 2032.

Each second arm 2032 is supported so as to pivot about a third pin 2074, with respect to the first arm 2031. Each second arm 2032 is supported so as to pivot about a fourth pin 2076, with respect to the cam plate 2020.

The intake camshaft 1120 is rotated relative to the sprocket 2010 by the pair of link mechanisms 2030, whereby the phase of the intake valve 100 is changed. Accordingly, even if one of the link mechanisms 2030 breaks and snaps, the phase of the intake valve 1100 is changed by the other link mechanism 2030.

As shown in FIG. 3, a control pin 2034 is fitted on one face of each link mechanism 2030 (more specifically, the second arm 2032), the face being proximal to the guide plate 2040. The control pin 2034 is arranged coaxially with the third pin 2074. Each control pin 2034 slides within a guide groove 2042 formed in the guide plate 2040.

Each control pin 2034 moves in the radial direction while sliding within the guide groove 2042 formed in the guide plate 2040. The movement of each control pin 2034 in the radial direction rotates the intake camshaft 1120 relative to the sprocket 2010.

Figure 7:
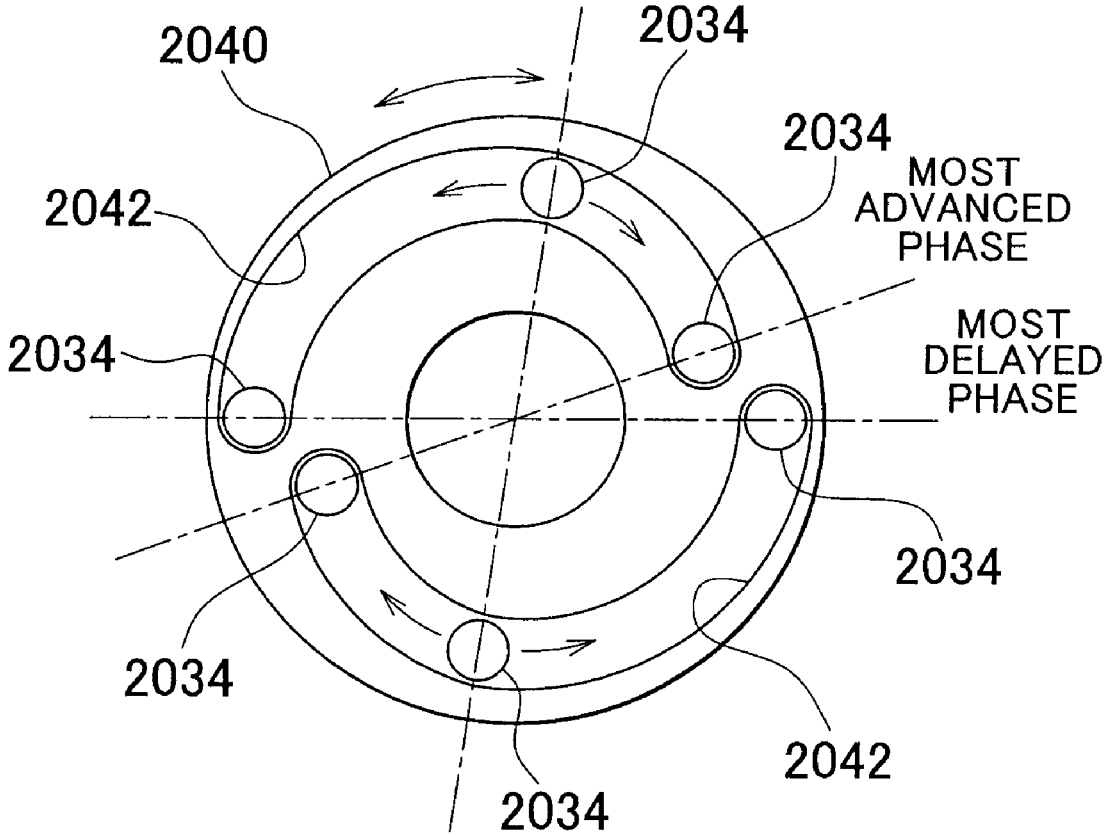
FIG. 7 is a cross-sectional view taken along the line VII-VII in FIG. 3.

As shown in FIG. 7, that is, a cross-sectional view taken along the line VII-VII in FIG. 3, the guide groove 2042 is formed in a spiral fashion such that the control pin 2034 moves in the radial direction in accordance with the rotation of the guide plate 2040. However, the shape of the guide groove 2042 is not limited to this.

As the distance between the control pin 2034 and the axis of the guide plate 2040 increases in the radial direction, the phase of the intake valve 1100 is more delayed. Namely, the amount of change in the phase corresponds to the amount by which each link mechanism 2030 is operated in accordance with the movement of the control pin 2034 in the radial direction. Note that, as the distance between the control pin 2034 and the axis of the guide plate 2040 increases in the radial direction, the phase of the intake valve 1100 may be more advanced.

As shown in FIG. 7, when the control pin 2034 reaches the end of the guide groove 2042, the operation of the link mechanism 2030 is restricted. Accordingly, the phase at which the control pin 2034 reaches the end of the guide groove 2042 is the most advanced phase or the most delayed phase of the intake valve 1100.

As shown in FIG. 3, multiple recesses 2044 are formed in one face of the guide plate 2040, the face being proximal to the speed reducer 2050. The recesses 2044 are used to connect the guide plate 2040 and the speed reducer 2050 to each other.

The speed reducer 2050 is formed of an externally-toothed gear 2052 and an internally-toothed gear 2054. The externally-toothed gear 2052 is fixed to the sprocket 2010 so as to rotate together with the sprocket 2010.

Multiple projections 2056, which are fitted in the recesses 2044 of the guide plate 2040, are formed on the internally-toothed gear 2054. The internally-toothed gear 2054 is supported so as to be rotatable about an eccentric axis 2066 of a coupling 2062 of which the axis deviates from an axis 2064 of the output shaft of the electric motor 2060.

Figure 8:
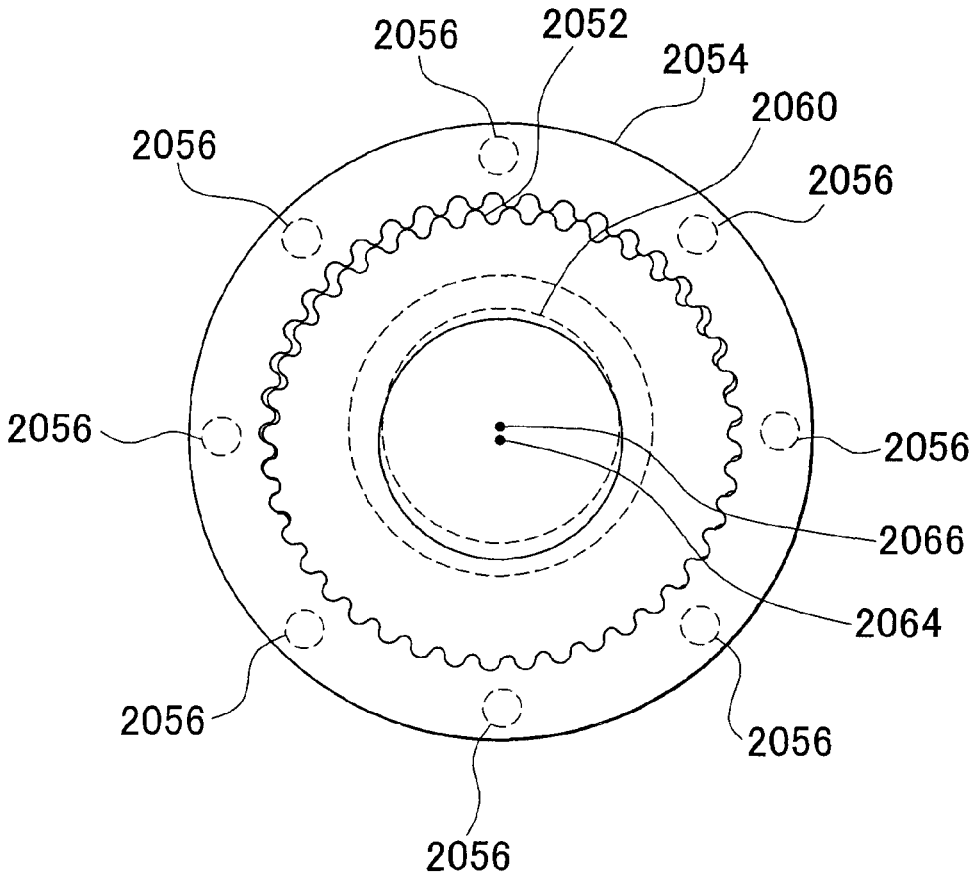
FIG. 8 is a cross-sectional view taken along the line VIII-VIII in FIG. 3.

FIG. 8 shows a cross-sectional view taken along the line VIII-VIII in FIG. 3. The internally-toothed gear 2054 is arranged such that part of the multiple teeth thereof mesh with the externally-toothed gear 2052. When the rotational speed of the output shaft of the electric motor 2060 is equal to the rotational speed of the sprocket 2010, the coupling 2062 and the internally-toothed gear 2054 rotate at the same rotational speed as the externally-toothed gear 2052 (the sprocket 2010). In this case, the guide plate 2040 rotates at the same rotational speed as the sprocket 2010, and the phase of the intake valve 1100 is maintained.

When the coupling 2062 is rotated about the axis 2064 relative to the externally-toothed gear 2052 by the electric motor 2060, the entirety of the internally-toothed gear 2054 turns around the axis 2064, and, at the same time, the internally-toothed gear 2054 rotates about the eccentric axis 2066. The rotational movement of the internally-toothed gear 2054 causes the guide plate 2040 to rotate relative to the sprocket 2010, whereby the phase of the intake valve 1100 is changed.

The phase of the intake valve 1100 is changed by reducing the relative rotational speed (the operation amount of the electric motor 2060) between the output shaft of the electric motor 2060 and the sprocket 2010 using the speed reducer 2050, the guide plate 2040 and the link mechanisms 2030.

Alternatively, the phase of the intake valve 1100 may be changed by increasing the relative rotational speed between the output shaft of the electric motor 2060 and the sprocket 2010. The output shaft of the electric motor 2060 is provided with a motor rotational angle sensor 5050 that outputs a signal indicating the rotational angle (the position of the output shaft in its rotational direction) of the output shaft. Generally, the motor rotational angle sensor 5050 produces a pulse signal each time the output shaft of the electric motor 2060 is rotated by a predetermined angle. The rotational speed of the output shaft of the electric motor 2060 (hereinafter, simply referred to as the "rotational speed of the electric motor 2060" where appropriate) is detected based on the signal output from the motor rotational angle sensor 5050.

Figure 9:
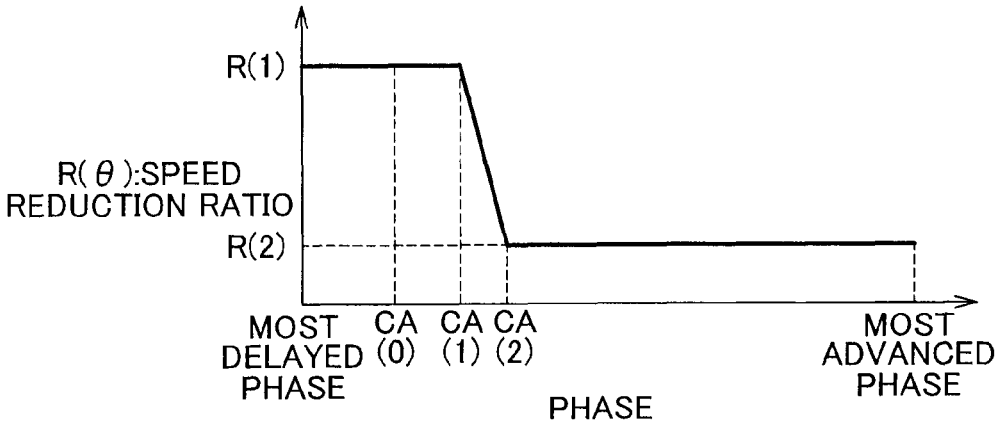
FIG. 9 is a graph showing the speed reduction ratio that the elements of the intake VVT mechanism realize in cooperation.

As shown in FIG. 9, the speed reduction ratio R (θ) that the elements of the intake VVT mechanism 2000 realize in cooperation, namely, the ratio of the relative rotational speed between the output shaft of the electric motor 2060 and the sprocket 2010 to the amount of change in the phase of the intake valve 1100 may take a value corresponding to the phase of the intake valve 1100. According to the embodiment of the invention, as the speed reduction ratio increases, the amount of change in the phase with respect to the relative rotational speed between the output shaft of the electric motor 2060 and the sprocket 2010 decreases.

When the phase of the intake valve 1100 is within the first region that extends from the most delayed phase to CA1, the speed reduction ratio that the elements of the intake VVT mechanism 2000 realize in cooperation is R1. When the phase of the intake valve 1100 is within the second region that extends from CA2 (CA2 is the phase more advanced than CA1) to the most advanced phase, the speed reduction ratio that the elements of the intake VVT mechanism 2000 realize in cooperation is R2 (R1>R2).

When the phase of the intake valve 1100 is within the third region that extends from CA1 to CA2, the speed reduction ratio that the elements of the intake VVT mechanism 2000 realize in cooperation changes at a predetermined rate ((R2−R1)/(CA2−CA1)).

The effects of the thus configured intake VVT mechanism 2000 of the variable valve timing system according to the embodiment of the invention will be described below.

Figure 10:
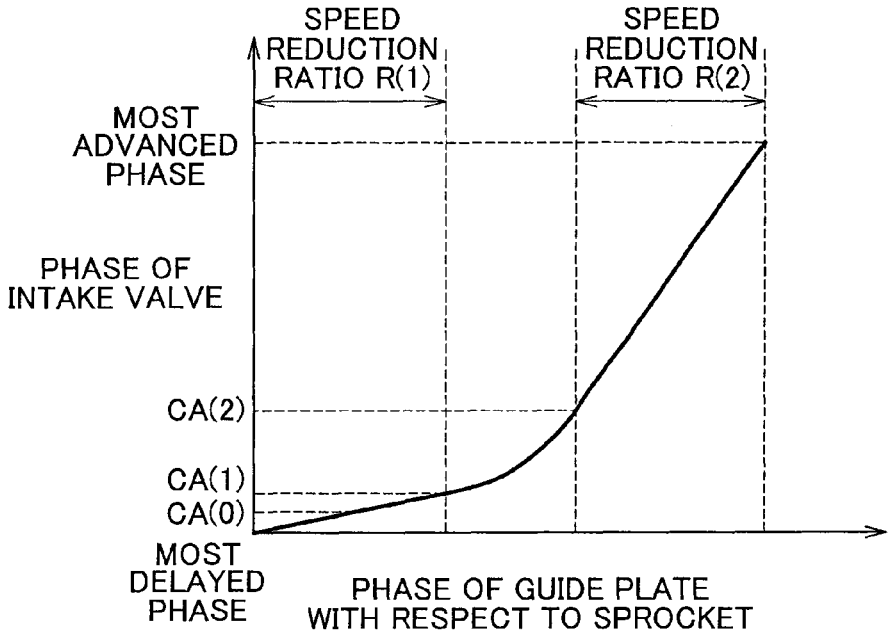
FIG. 10 is a graph showing the relationship between the phase of a guide plate relative to a sprocket and the phase of the intake camshaft.

When the phase of the intake valve 1100 (the intake camshaft 1120) is advanced, the electric motor 2060 is operated to rotate the guide plate 2040 relative to the sprocket 2010. As a result, the phase of the intake valve 1100 is advanced, as shown in FIG. 10.

When the phase of the intake valve 1100 is within the first region that extends from the most delayed phase to CA1, the relative rotational speed between the output shaft of the electric motor 2060 and the sprocket 2010 is reduced at the speed reduction ratio R1. As a result, the phase of the intake valve 1100 is advanced.

When the phase of the intake valve 1100 is within the second region that extends from CA2 to the most advanced phase, the relative rotational speed between the output shaft of the electric motor 2060 and the sprocket 2010 is reduced at the speed reduction ratio R2. As a result, the phase of the intake valve 1100 is advanced.

When the phase of the intake valve 1100 is delayed, the output shaft of the electric motor 2060 is rotated relative to the sprocket 2010 in the direction opposite to the direction in which the phase of the intake valve 1100 is advanced. When the phase is delayed, the relative rotational speed between the output shaft of the electric motor 2060 and the sprocket 2010 is reduced in the manner similar to that when the phase is advanced. When the phase of the intake valve 1100 is within the first region that extends from the most delayed phase to CA1, the relative rotational speed between the output shaft of the electric motor 2060 and the sprocket 2010 is reduced at the speed reduction ratio R1. As a result, the phase is delayed. When the phase of the intake valve 1100 is within the second region that extends from CA2 to the most advanced phase, the relative rotational speed between the output shaft of the electric motor 2060 and the sprocket 2010 is reduced at the speed reduction ratio R2. As a result, the phase is delayed.

Accordingly, as long as the direction of the relative rotation between the output shaft of the electric motor 2060 and the sprocket 2010 remains unchanged, the phase of the intake valve 1100 may be advanced or delayed in both the first region that extends from the most delayed phase to CA1 and the second region that extends from the CA2 to the most advanced phase. In this case, in the second region that extends from CA2 to the most advanced phase, the phase is advanced or delayed by an amount larger than that in the first region that extends from the most delayed phase to CA1. Accordingly, the first region is broader in the phase change width than the second region.

In the first region that extends from the most delayed phase to CA1, the speed reduction ratio is high. Accordingly, a high torque is required to rotate the output shaft of the electric motor 2060 using the torque applied to the intake camshaft 1120 in accordance with the operation of the engine 1000. Therefore, even when the electric motor 2060 does not produce a torque, for example, even when the electric motor 2060 is not operating, the rotation of the output shaft of the electric motor 2060, which is caused by the torque applied to the intake camshaft 1120, is restricted. This restricts the deviation of the actual phase from the phase used in the control. In addition, occurrence of an undesirable phase change is restricted when the supply of electricity to the electric motor 2060 that serves as the actuator is stopped.

Preferably, the relationship between the direction in which the electric motor 2060 rotates relative to the sprocket 2010 and the advance/delay of the phase is set such that the phase of the intake valve 1100 is delayed when the output shaft of the electric motor 2060 is lower in rotational speed than the sprocket 2010. Thus, when the electric motor 2060 that serves as the actuator becomes inoperative while the engine is operating, the phase of the intake valve 1100 is gradually delayed, and finally agrees with the most delayed phase. Namely, even if the intake valve phase control becomes inexecutable, the phase of the intake valve 1100 is brought into a state in which combustion stably takes place in the engine 1000.

When the phase of the intake valve 1100 is within the third region that extends from CA1 to CA2, the relative rotational speed between the output shaft of the electric motor 2060 and the sprocket 2010 is reduced at the speed reduction ratio that changes at a predetermined rate. As a result, the phase of the intake valve 1100 is advanced or delayed.

When the phase of the intake valve 1100 is shifted from the first region to the second region, or from the second region to the first region, the amount of change in the phase with respect to the relative rotational speed between the output shaft of the electric motor 2060 and the sprocket 2010 is gradually increased or reduced. Accordingly, an abrupt stepwise change in the amount of change in the phase is restricted to restrict an abrupt change in the phase. As a result, the phase of the intake valve 1100 is controlled more appropriately.

With the intake VVT mechanism 2000 of the variable valve timing system according to the embodiment of the invention described above, when the phase of the intake valve 1100 is within the first region that extends from the most delayed phase to CA1, the speed reduction ratio that the elements of the intake VVT mechanism 2000 realize in cooperation is R1. When the phase of the intake valve is within the second region that extends from CA2 to the most advanced phase, the speed reduction ratio that the elements of the intake VVT mechanism 2000 realize in cooperation is R2 that is lower than R1. Accordingly, as long as the direction in which the output shaft of the electric motor 2060 remains unchanged, the phase of the intake valve 1100 may be both advanced and delayed in both the first region that extends from the most delayed phase to CA1 and the second region that extends from the CA2 to the most advanced phase.

In this case, in the second region that extends from CA2 to the most advanced phase, the phase is advanced or delayed by an amount larger than that in the first region that extends from the most delayed phase to CA1. Accordingly, the second region is broader in the phase change width than the first region.

In the first region that extends from the most delayed phase to CA1, the speed reduction ratio is high. Accordingly, the rotation of the output shaft of the electric motor 2060, which is caused by the torque applied to the intake camshaft 1120 in accordance with the operation of the engine, is restricted. This restricts the deviation of the actual phase from the phase used in the control. As a result, the phase change width is broad, and the phase is controlled accurately.

In the engine 1000, the phase CA0 of the intake valve 1100, which is used as the target phase when the engine is idling, namely, the intake valve phase CA0 at which the combustion takes place stably (hereinafter, referred to as the "stable combustion phase CA0") is present in the middle of the control range in which the phase of the intake valve 1100 is variably set, unlike the most delayed phase. The first region in which the speed reduction ratio is high is set to include the stable combustion phase CA0. The stable combustion phase CA0 may be regarded as "reference timing" according to the invention.

Next, the intake valve phase control executed by the variable valve timing system according to the embodiment of the invention will be described in detail.

Figure 11:
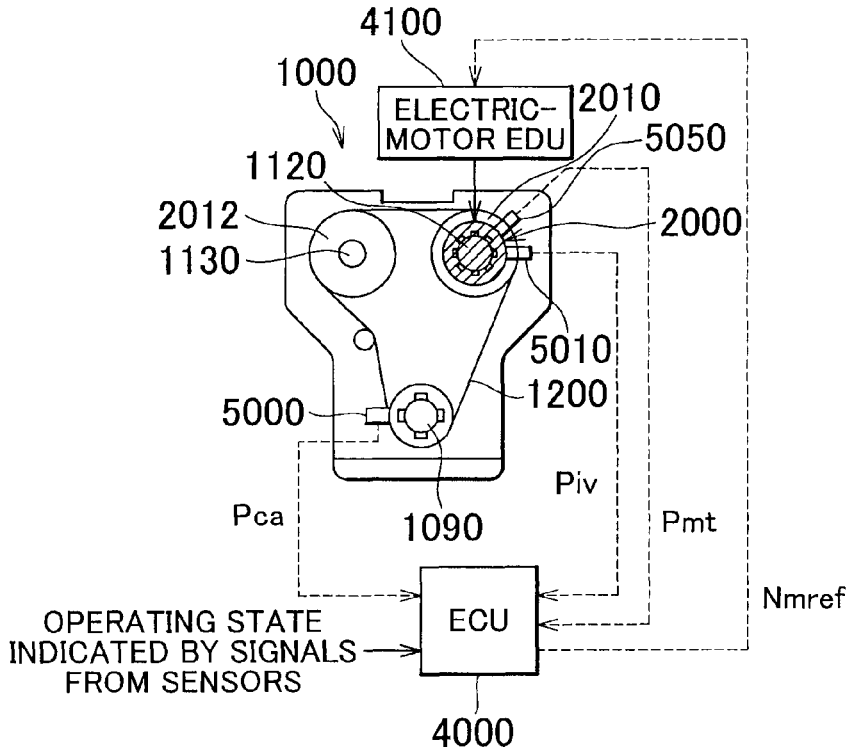
FIG. 11 is a schematic block diagram illustrating the configuration of the control over the phase of the intake valve, executed by the variable valve timing system according to the embodiment of the invention.

FIG. 11 is a schematic block diagram illustrating the configuration of the intake valve phase control executed by the variable valve timing system according to the embodiment of the invention.

As shown in FIG. 11, the engine 1000 is configured such that the power is transferred from the crank shaft 1090 to the intake camshaft 1120 and the exhaust camshaft 1130 via the sprocket 2010 and a sprocket 2012, respectively, by a timing chain 1200 (or a timing belt), as previously described with reference to FIG. 1. The camshaft position sensor 5010 that outputs a cam angle signal Piv each time the intake camshaft 1120 rotates by a predetermined cam angle is fitted on the outer periphery of the intake camshaft 1120. The crank angle sensor 5000 that outputs a crank angle signal Pca each time the crankshaft 1090 rotates by a predetermined crank angle is fitted on the outer periphery of the crankshaft 1090. The motor rotational angle sensor 5050 that outputs a motor rotational angle signal Pmt each time the electric motor 2060 rotates by a predetermined rotational angle is fitted to a rotor (not shown) of the electric motor 2060. These cam angle signal Piv, crank angle signal Pca and motor rotational angle signal Pmt are transmitted to the ECU 4000.

The ECU 4000 controls the operation of the engine 1000 based on the signals output from the sensors that detect the operating state of the engine 1000 and the operation conditions (the pedal operations performed by the driver, the current vehicle speed, etc.) such that the engine 1000 produces a required output power. As part of the engine control, the ECU 4000 sets the target phase of the intake valve 1100 and the target phase of the exhaust valve 1110 based on the map shown in FIG. 2. In addition, the ECU 4000 sets the control target value of the phase of the intake valve 1100, which is the target of the intake valve control, based on the target phase. Then, the ECU 4000 prepares the rotational speed command value Nmref for the electric motor 2060 that serves as the actuator of the intake VVT mechanism 2000 such that the actual phase of the intake valve 1100 matches the control target value.

As will be described below, the rotational speed command value Nmref is set based on the relative rotational speed between the output shaft of the electric motor 2060 and the sprocket 2010 (the intake camshaft 1120), which corresponds to the operation amount of the actuator. An electric-motor EDU (Electronic Drive Unit) 4100 controls the rotational speed of the electric motor 2060 based on the rotational speed command value Nmref indicated by a signal from the ECU 4000.

Figure 12:
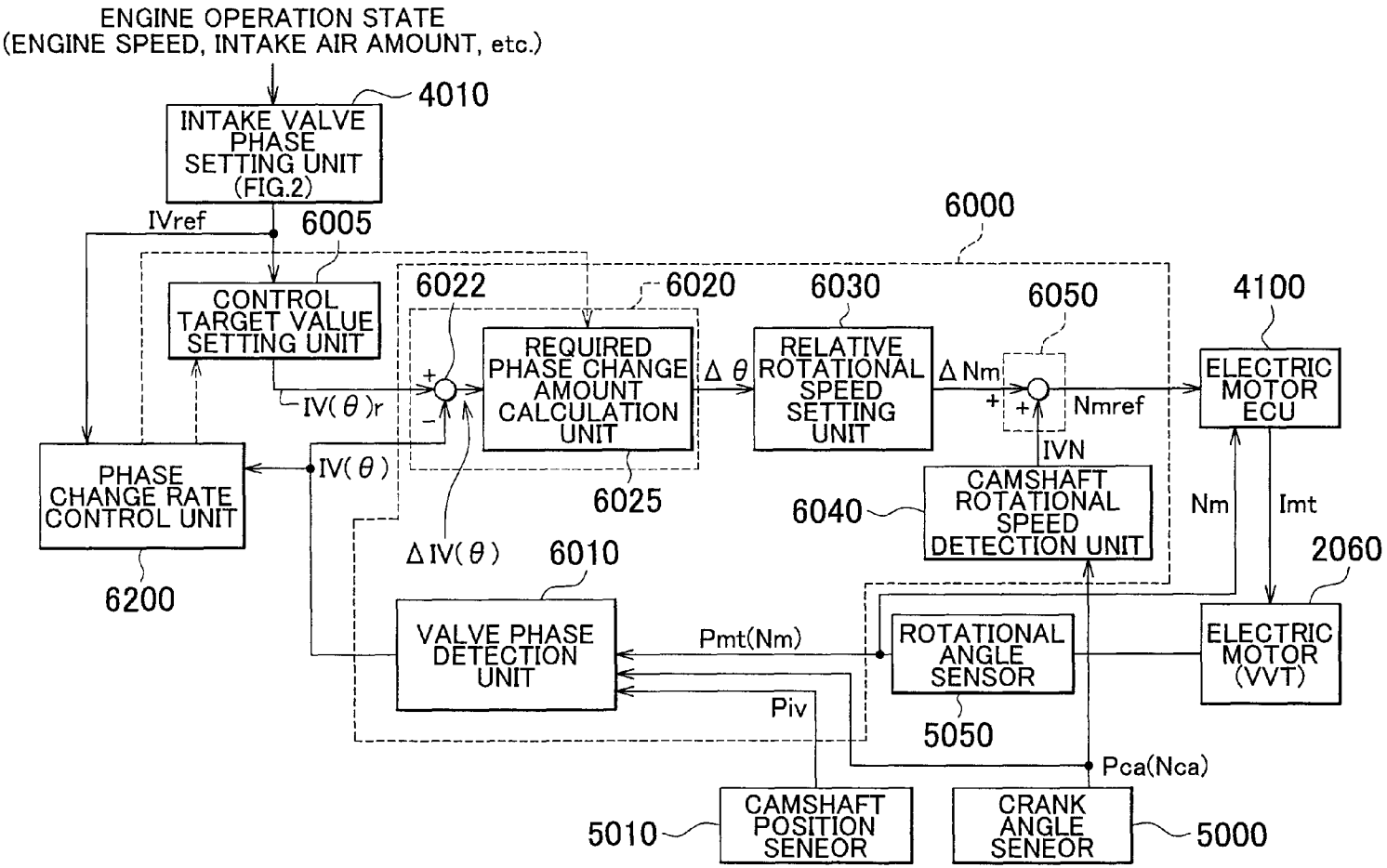
FIG. 12 is a block diagram illustrating the configuration of the control over the rotational speed of an electric motor that serves as an actuator of the variable valve timing system according to the embodiment of the invention.

FIG. 12 is a block diagram illustrating the rotational speed control over the electric motor 2060 that serves as the actuator of the intake VVT mechanism 2000 according to the embodiment of the invention.

An intake valve phase setting unit 4010 shown in FIG. 12 corresponds to the map shown in FIG. 2. The intake valve phase setting unit 4010 sets the target phase IVref of the intake valve 1100, which is the target of the variable valve timing control, based on the parameters indicating the engine operating state (the engine speed and the intake air amount, in the example in FIG. 2).

A control target value setting unit 6005 sets the control target value IV(θ)r of the phase of the intake valve 1100 (hereinafter, referred to as the "intake valve phase" where appropriate) based on the target phase IVref set by the intake valve phase setting unit 4010. As will be described in detail later, a phase change rate control unit 6200 exerts an influence on setting of the control target value IV(θ)r by the control target value setting unit 6005.

An actuator operation amount setting unit 6000 prepares the rotational speed command value Nmref for the electric motor 2060 based on the deviation of the current actual phase IV(θ) of the intake valve 1100 (hereinafter, referred to as the "actual intake valve phase IV(θ)" where appropriate) from the control target value IV(θ)r set by the control target value setting unit 6005. The rotational speed command value Nmref is set such that the actuator operation amount at which the actual intake valve phase IV(θ) matches the control target value IV(θ)r is achieved.

The actuator operation amount setting unit 6000 includes a valve phase detection unit 6010; a camshaft phase change amount calculation unit 6020; a relative rotational speed setting unit 6030; a camshaft rotational speed detection unit 6040; and a rotational speed command value preparation unit 6050. The function of the actuator operation amount setting unit 6000 is exhibited by executing the control routines stored in the ECU 4000 in advance in predetermined control cycles.

The valve phase detection unit 6010 calculates the actual intake valve phase IV(θ) based on the crank angle signal Pca from the crank angle sensor 5000, the cam angle signal Piv from the camshaft position sensor 5010, and the motor rotational angle signal Pmt from the rotational angle sensor 5050 for the electric motor 2060.

The camshaft phase change amount calculation unit 6020 includes a calculation unit 6022 and a required phase change amount calculation unit 6025. The calculation unit 6022 calculates the deviation ΔIV(θ) (ΔIV(θ)=IV(θ)−IV(θ)r) of the actual intake valve phase IV(θ) from the target phase IV(θ)r.

The required phase change amount calculation unit 6025 calculates the amount Δθ by which the phase of the intake camshaft 1120 is required to change (hereinafter, referred to as the "required phase change amount Δθ for the intake camshaft 1120") in the current control cycle based on the calculated deviation ΔIV(θ).

For example, the maximum control amount θmax, which is the maximum value of the required phase change amount Δθ in a single control cycle, is set in advance. The required phase change amount calculation unit 6025 sets the required phase change amount Δθ, which corresponds to the deviation ΔIV(θ) and which is equal to or smaller than the maximum control amount θmax. The maximum control amount θmax may be a fixed value. Alternatively, the maximum control amount θmax may be variably set by the required phase change amount calculation unit 6025 based on the operating state of the engine 1000 (the engine speed, the intake air amount, etc.) and the deviation ΔIV(θ) of the actual intake valve phase IV(θ) from the target phase IV(θ)r.

The relative rotational speed setting unit 6030 calculates the rotational speed ΔNm of the output shaft of the electric motor 2060 relative to the rotational speed of the sprocket 2010 (the intake camshaft 1120). The rotational speed ΔNm needs to be achieved in order to obtain the required phase change amount Δθ calculated by the required phase change amount calculation unit 6025. For example, the relative rotational speed ΔNm is set to a positive value (ΔNm>0) when the phase of the intake valve 1100 is advanced. On the other hand, when the phase of the intake valve 1100 is delayed, the relative rotational speed ΔNm is set to a negative value (ΔNm<0). When the current phase of the intake valve 1100 is maintained (Δθ=0), the relative rotational speed ΔNm is set to a value substantially equal to zero (ΔNm=0).

The relationship between the required phase change amount Δθ per unit time ΔT corresponding to one control cycle and the relative rotational speed ΔNm is expressed by Equation 1 shown below. In Equation 1, R(θ) is the speed reduction ratio that changes in accordance with the phase of the intake valve 1100, as shown in FIG. 9.

$$\Delta\theta \propto \Delta Nm \times 360° \times (1/R(\theta)) \times \Delta T \qquad \text{Equation 1}$$

According to Equation 1, the relative rotational speed setting unit 6030 calculates the rotational speed ΔNm of the electric motor 2060 relative to the rotational speed of the sprocket 2010, the relative rotational speed ΔNm being required to be achieved to obtain the required phase change amount Δθ of the camshaft during the control cycle ΔT.

The camshaft rotational speed detection unit 6040 calculates the rotational speed of the sprocket 2010, namely, the actual rotational speed IVN of the intake camshaft 1120 by dividing the rotational speed of the crankshaft 1090 by two. Alternatively, the camshaft rotational speed detection unit 6040 may calculate the actual rotational speed IVN of the intake camshaft 1120 based on the cam angle signal Piv from the camshaft position sensor 5010. Generally, the number of cam angle signals output during one rotation of the intake camshaft 1120 is smaller than the number of crank angle signals output during one rotation of the crankshaft 1090. Accordingly, the accuracy of detection is enhanced by detecting the camshaft rotational speed IVN based on the rotational speed of the crankshaft 1090.

The rotational speed command value preparation unit 6050 prepares the rotational speed command value Nmref for the electric motor 2060 by adding the actual rotational speed IVN of the intake camshaft 1120, which is calculated by the camshaft rotational speed detection unit 6040, to the relative rotational speed ΔNm set by the relative rotational speed setting unit 6030. A signal indicating the rotational speed command value Nmref prepared by the rotational speed command value preparation unit 6050 is transmitted to the electric-motor EDU 4100.

The electric-motor EDU 4100 executes the rotational speed control such that the rotational speed of the electric motor 2060 matches the rotational speed command value Nmref. For example, the electric-motor EDU 4100 controls the on/off state of a power semiconductor element (e.g. a transistor) to control the electric power supplied to the electric motor 2060 (typically, the magnitude of electric current Imt passing through the electric motor 2060 and the amplitude of the voltage applied to the electric motor 2060) based on the deviation (Nmref−Nm) of the actual rotational speed Nm of the electric motor 2060 from the rotational speed command value Nmref. For example, the duty ratio used in the on/off operation of the power semiconductor element is controlled.

In order to control the electric motor 2060 more efficiently, the electric-motor EDU 4100 controls the duty ratio DTY that is the adjustment amount used in the rotational speed control is controlled according to Equation 2 shown below.

$$DTY = DTY(ST) + DTY(FB) \qquad \text{Equation 2}$$

In Equation 2, DTY(FB) is a feedback term based on the control calculation using the above-described deviation and a predetermined control gain (typically, common P control or PI control).

Figure 13:
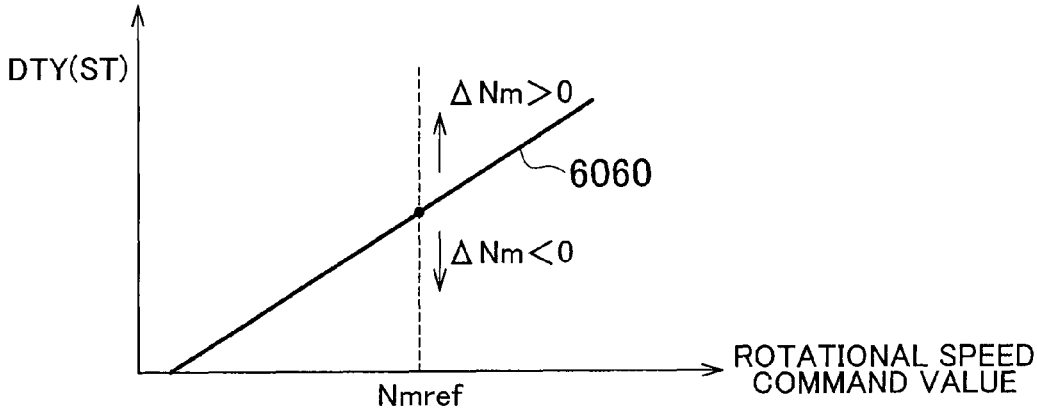
FIG. 13 is a graph illustrating the control over the rotational speed of the electric motor.

DTY(ST) in Equation 2 is a preset term that is set based on the rotational speed command value Nmref for the electric motor 2060, as shown in FIG. 13.

As shown in FIG. 13, a duty ratio characteristic 6060 corresponding to the motor current value required when the relative rotational speed ΔNm is zero (ΔNm=0), namely, when the electric motor 2060 is rotated at the same rotational speed as the sprocket 2010 based on the rotational speed command value Nmref is presented in a table in advance. DTY(ST) in Equation 2 is set based on the duty ratio characteristic 6060. Alternatively, DTY(ST) in Equation 2 may be set by relatively increasing or decreasing the value of the duty ratio corresponding to the relative rotational speed ΔNm from the reference value based on the duty ratio characteristic 6060.

The rotational speed control, in which the electric power supplied to the electric motor 2060 is controlled using both the preset term and the feedback term in combination, is executed. In this way, the electric-motor EDU 4100 causes the rotational speed of the electric motor 2060 to match the rotational speed command value Nmref, even if it changes, more promptly than in a simple feedback control, namely, the rotational speed control in which the electric power supplied to the electric motor 2060 is controlled using only the feedback term DTY(FB) in Equation 2.

Next, the manner in which the control target value IV(θ) is set by the control target value setting unit 6005 will be described.

Figure 14:
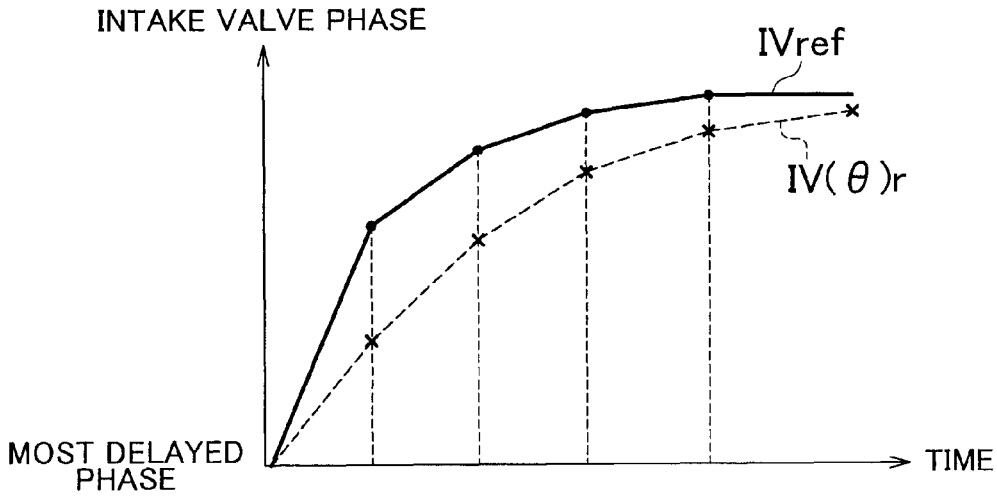
FIG. 14 is a waveform chart illustrating the manner in which the control target value used in the intake valve phase control is set by smoothing a change in the target phase in the direction of time axis.

As shown in FIG. 14, the intake valve phase setting unit 4010 successively sets the target phase IVref based on the map shown in FIG. 2 based on the current engine operating state. Accordingly, the target phase IVref may change abruptly. If the intake valve control is executed in response to such an abrupt change without making any adjustments, the combustion state in the engine 1000 may become unstable due to the abrupt change in the intake valve phase.

Accordingly, the control target value setting unit 6005 is configured to set the control target value IV(θ)r used in the intake valve phase control by smoothing a change in the target phase IVref set by the intake valve phase setting unit 4010 in the direction of time axis. For example, the control target value setting unit 6005 sets the new (current) control target value IV(θ)r based on the immediately preceding control target value IV(θ)r (hereinafter, referred to as IV(θ)r0 in order to distinguish from the new control target value IV(θ)r) and the new (current) target phase IVref according to Equation 3 indicated below.

$$IV(\theta)r=IV(\theta)r0+(IVref-IV(\theta)r0)/kn \quad \text{Equation 3}$$

The smoothing coefficient kn (kn≧1.0) in Equation 3 is used to set the degree of smoothing in the direction of time axis. When the smoothing coefficient kn is 1.0 (kn=1.0), the new control target value IV(θ)r, which is the solution of Equation 3, is equal to the new target phase IVref (IV(θ)r=IVref), and the degree of smoothing in the direction of time axis is zero. The control target value IV(θ)r used in the intake valve control executed by the actuator operation amount setting unit 6000 is directly set to the target phase IVref set by the intake valve phase setting unit 4010. When the smoothing coefficient kn is smaller than 1.0 (kn>1.0), the control target value IV(θ) is updated in a manner in which only part of the difference between the immediately preceding control target value IV(θ)r0 and the target phase IVref is reflected on the updated control target value IV(θ)r. Accordingly, a change in the control target value IV(θ) is smoothed in the direction of time axis. As the smoothing coefficient kn increases, the degree of smoothing in the direction of time axis increases.

Figure 15:
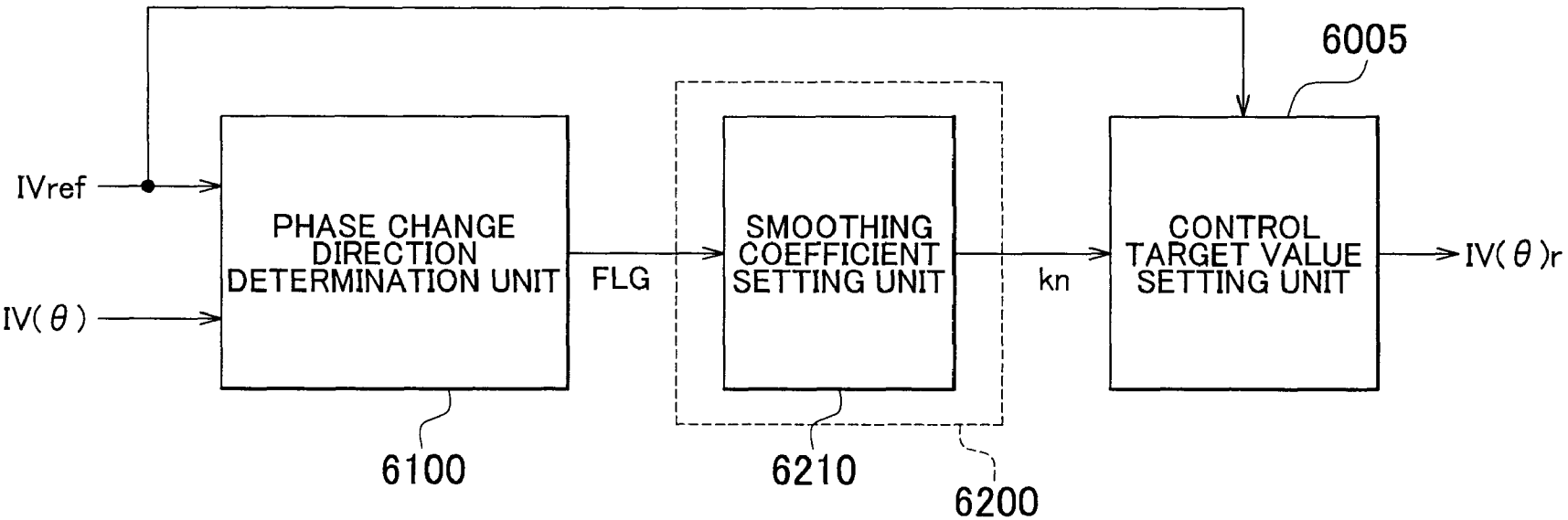
FIG. 15 is a block diagram illustrating the manner in which the control target value used in the intake valve control is set.

FIG. 15 is a block diagram illustrating the manner in which the control target value used in the intake valve control is set. As shown in FIG. 15, a phase change direction determination unit 6100 sets the flag FLG that indicates whether the direction, in which the phase of the intake valve 1100 is changed by the immediately subsequent intake valve phase control, is the direction in which the phase of the intake valve 1100 approaches the stable combustion phase CA(0) (the first direction) or the direction in which the phase of the intake valve 1100 moves away from the stable combustion phase CA(0) (the second direction). The phase change direction determination unit 6100 sets the flag FLG based on the target phase IVref set by the intake valve phase setting unit 4010 and the current actual intake valve phase IV(θ).

The phase change rate control unit 6200 includes a smoothing coefficient setting unit 6210. The smoothing coefficient setting unit 6210 variably sets the smoothing coefficient kn in Equation 3 based on the direction in which the phase of the intake valve 1100 changes (the first direction or the second direction) and which is indicated by the flag FLG. Then, the control target value setting unit 6005 sets the control target value IV(θ)r according to the Equation 3 using the smoothing coefficient kn that is variably set by the smoothing coefficient setting unit 6210.

Figure 16:
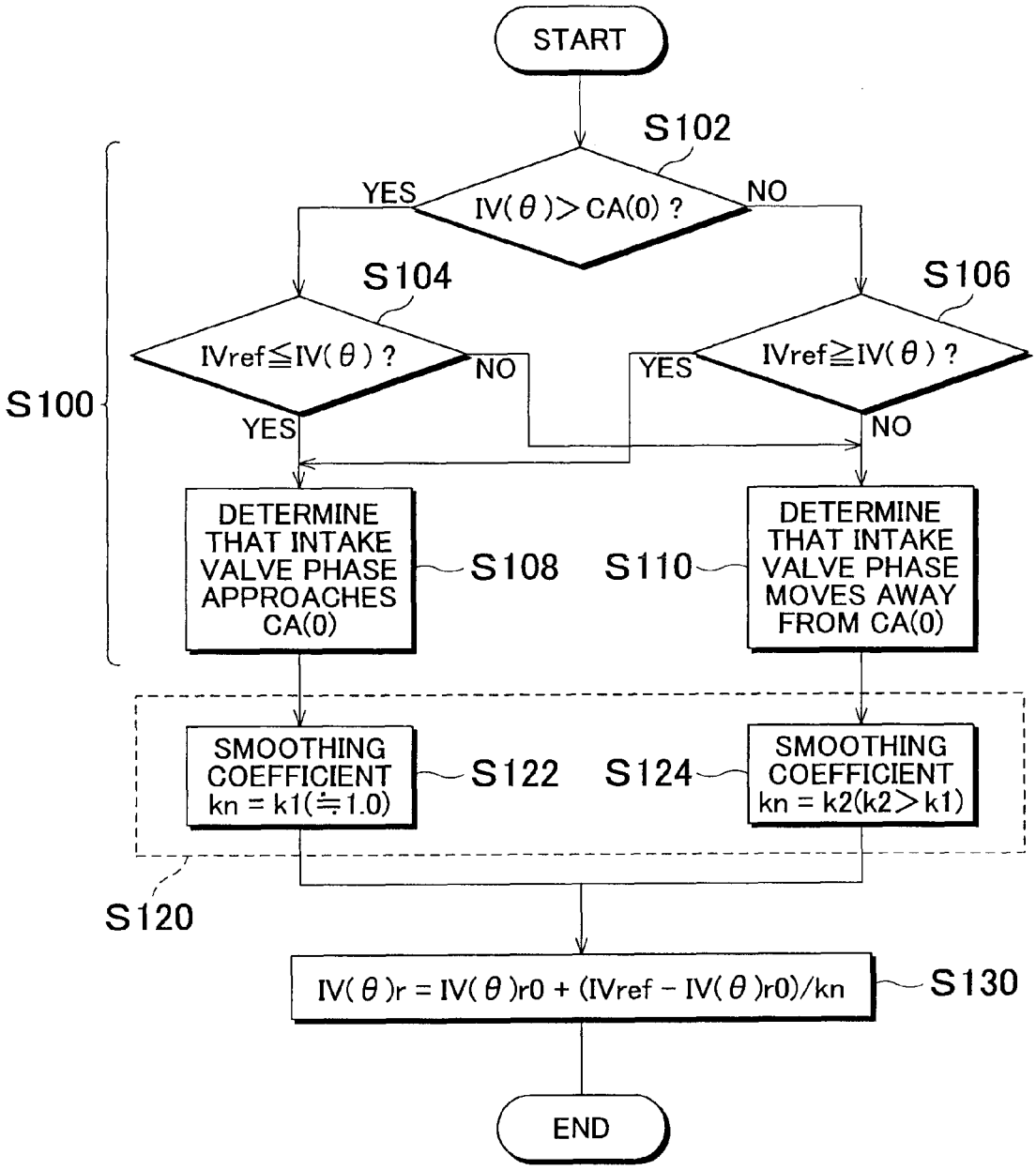
FIG. 16 is a flowchart illustrating the first example of the phase change rate control in the intake valve phase control executed by the variable valve timing system according to the embodiment of the invention.

With the configuration shown in FIG. 15, in the intake valve phase control executed by the variable valve timing system according to the embodiment of the invention, the rate of change in the phase of the intake valve 1100 is controlled according to the flowchart shown in FIG. 16 by executing the program stored in the ECU 4000 in predetermined control cycles.

As shown in FIG. 16, the ECU 4000 executes step group S100 for executing the function of the phase change direction determination unit 6100, step group S120 for executing the function of the smoothing coefficient setting unit 6210, and step S130 for executing the function of the control target value setting unit 6005.

Step group S100 includes steps S102 to S110. In step S110, the ECU 4000 compares the current actual intake valve phase IV(θ) with the stable combustion phase CA(0). When it is determined that the actual intake valve phase IV(θ) is more advanced than the stable combustion phase CA(0) ("YES" in S102), the ECU 4000 determines in step S104 whether the target phase IVref matches the actual intake valve phase IV(θ) or is more delayed than the actual intake valve phase IV(θ).

On the other hand, when it is determined that the actual intake valve phase IV(θ) matches the stable combustion phase CA(0) or is more delayed than the stable combustion phase CA(0) ("NO" in step S102), the ECU 4000 determines in step S106 whether the target phase IVref matches the actual intake valve phase IV(θ) or is more advanced than the actual intake valve phase IV(θ).

When an affirmative determination is made in step S104 or step S106, the ECU determines in step S108 that the direction of an immediately subsequent change in the intake valve phase is the direction in which the intake valve phase approaches the stable combustion phase CA(0) (the first direction). On the other hand, when a negative determination is made in step S104 or step S106, the ECU 4000 determines in step S110 that the direction of an immediately subsequent change in the intake valve phase is the direction in which the intake valve phase moves away from the stable combustion phase CA(0) (the second direction).

In this way, it is possible to determine whether the direction, in which the intake valve phase is changed by the immediately subsequent intake valve phase control according to the target phase IVref, is the direction in which the intake valve phase approaches the stable combustion phase CA(0) (the first direction) or the direction in which the intake valve phase moves away from the stable combustion phase CA(0) (the second direction). Such determination is made based on the correlation among the actual intake valve phase IV(θ), the target phase IVref, and the stable combustion phase CA(0).

Step group S120 includes step S122 and step S124. In step S122, the ECU 4000 sets the smoothing coefficient to k1 (kn=k1) which is used when the direction of a change in the intake valve phase is the direction in which the intake valve phase approaches the stable combustion phase CA(0) (the first direction). For example, the smoothing coefficient k1 is set to 1.0 (k1=1.0).

In step S124, the ECU 4000 sets the smoothing coefficient to k2 (kn=k2) which is used when the direction of a change in the intake valve phase is the direction in which the intake valve phase moves away from the stable combustion phase CA(0) (the second direction). The smoothing coefficient k2 is set to a value that is larger than the smoothing coefficient k1 (k2>k1).

With this configuration, when a change in the valve phase, which is caused by executing the valve timing control based on the engine operating state, reduces the combustion stability in the engine, the phase change rate control is executed such that the actual rate of phase change with respect to a change in the target phase IVref based on the engine operating state is restricted. Thus, it is possible to prevent a negative influence on the combustion stability in the engine due to the valve timing control.

On the other hand, when a change in the valve phase, which is caused by executing the valve timing control, enhances the combustion stability in the engine, the phase change rate control is executed such that the actual rate of phase change with respect to a change in the target phase IVref based on the engine operating state is increased. Accordingly, in such a case, the total engine performance is enhanced by achieving the effects of the valve timing control.

With the variable valve timing system according to the embodiment of the invention described above, the valve timing control based on the engine operating state is executed while a sufficient level of combustion stability is maintained.

In the example shown in FIG. 16, the smoothing coefficient kn is set to one of two levels selected based on the direction in which the intake valve phase changes (the first direction or the second direction). Alternatively, in at least one of the first and second directions, multiple levels for the smoothing coefficient kn may be prepared, and the smoothing coefficient kn may be set to one of the multiple levels based on the difference between the actual intake valve phase and the stable combustion phase CA(0).

Next, another example of the phase change rate control in the intake valve phase control will be described.

Figure 17:
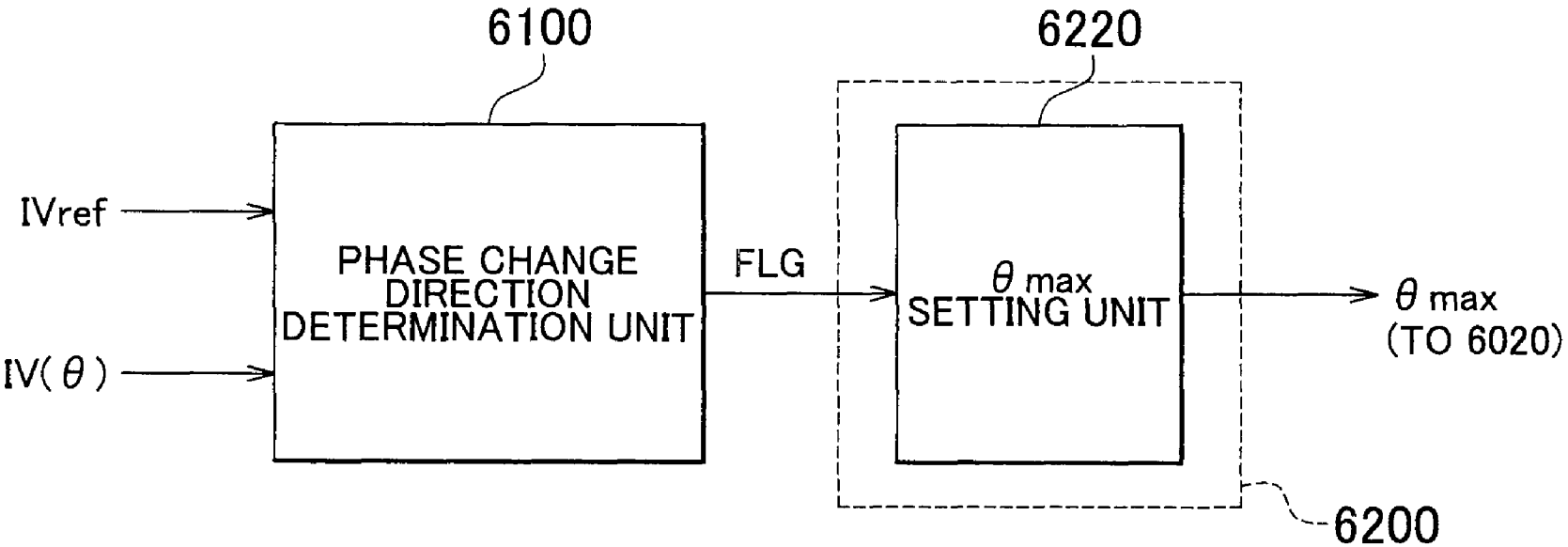
FIG. 17 is a block diagram illustrating the manner in which the maximum control amount is set in each control cycle of the intake valve control.

FIG. 17 is a block diagram illustrating the manner in which the maximum control amount is set in each control cycle of the intake valve control.

As shown in FIG. 17, the phase change rate control unit 6200 includes a maximum control amount (θmax) setting unit 6220. The maximum control amount setting unit 6220 sets the maximum control amount θmax, by which the required phase change amount calculation unit 6025 (FIG. 12) is allowed to change, based on the flag FLG from the phase change direction determination unit 6100, as in the case shown in FIG. 15.

Figure 18:
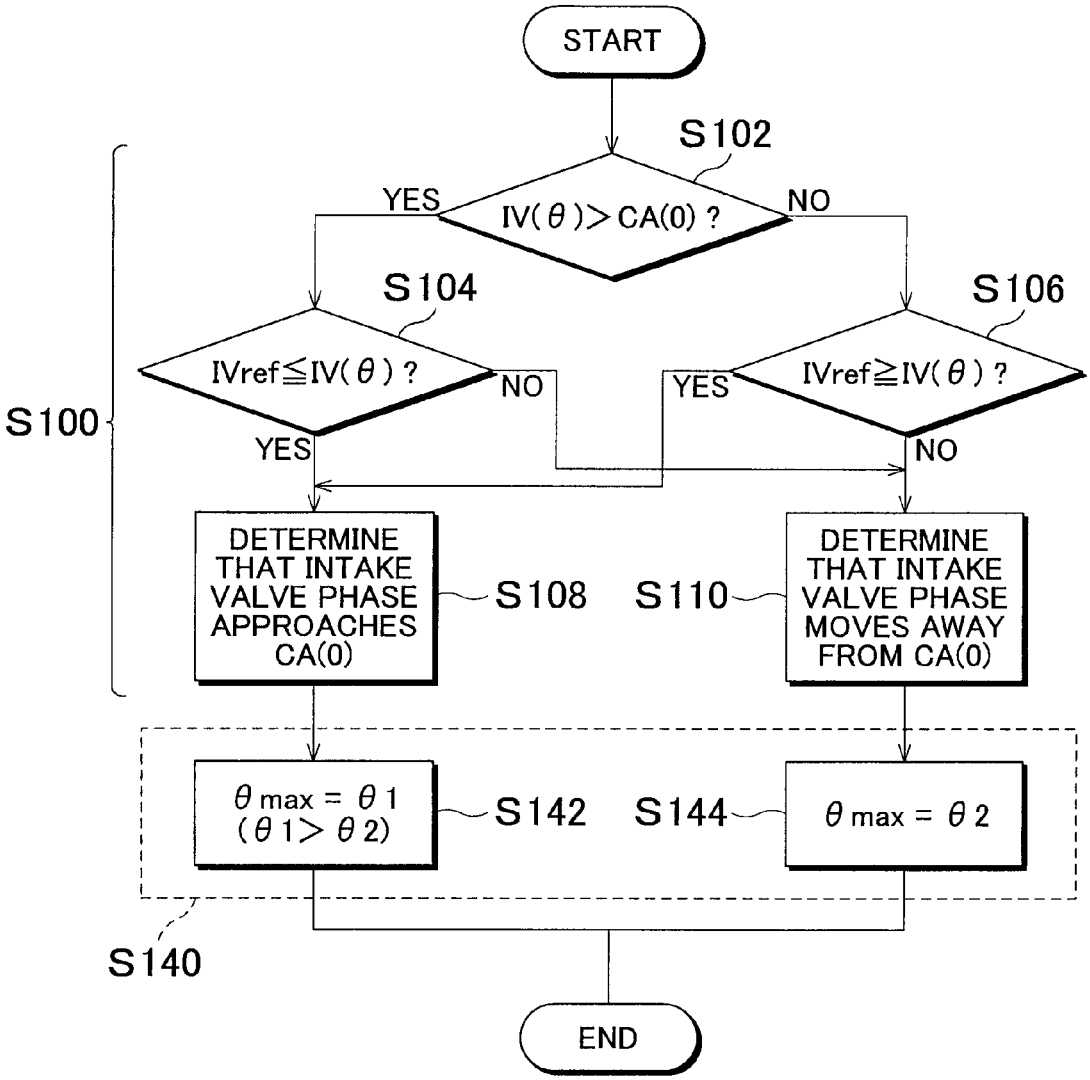
FIG. 18 is a flowchart illustrating the second example of the phase change rate control in the intake valve phase control executed by the variable valve timing system according to the embodiment of the invention.

With the configuration shown in FIG. 17, in the intake valve phase control executed by the variable valve timing system according to the embodiment of the invention, the rate of change in the intake valve phase is controlled according to the flowchart shown in FIG. 18 by executing the program stored in the ECU 4000 in predetermined control cycles.

As shown in FIG. 18, the ECU 4000 executes step group S100 for executing the function of the phase change direction determination unit 6100, and step group S140 for executing the function of the maximum control amount setting unit 6220.

As in the case shown in FIG. 15, step group S100 includes steps S102 to S110. Namely, the ECU 4000 determines whether the direction, in which the intake valve phase is changed by the immediately subsequent intake valve phase control in accordance with the target phase IVref, is the direction in which the intake valve phase approaches the stable combustion phase CA(0) (the first direction) or the direction in which the intake valve phase moves away from the stable combustion phase CA(0) (the second direction). The determination is made based on the correlation among the actual intake valve phase IV(θ), the target phase IVref, and the stable combustion phase CA(0).

Step group S140 includes step S142 and step S144. In step S142, the ECU 4000 sets the maximum control amount θ1 (θmax=θ1) which is used when the direction of a change in the intake valve phase is the direction in which the intake valve phase approaches the stable combustion phase CA(0) (the first direction).

In step S144, the ECU 4000 sets the maximum control amount θ2 (θmax θ2) which is used when the direction of a change in the intake valve phase is the direction in which the intake valve phase moves away from the stable combustion phase CA(0) (the second direction). At this time, the maximum control amount θ2 is set to a value smaller than the maximum control amount θ1.

With this configuration, when a valve timing change, which is caused by executing the valve timing control based on the engine operating state, reduces the combustion stability in the engine, the rate of phase change is restricted by restricting the maximum control amount, namely, the maximum amount of phase change in one control cycle. On the other hand, when a valve timing change, which is caused by executing the valve timing control, enhances the combustion stability in the engine, the rate of phase change is increased by maintaining the sufficient maximum control amount, namely, the sufficient amount of phase change in one control cycle.

As shown in FIG. 18, the maximum control amount θmax is set to one of two levels selected based on the direction in which the intake valve phase changes (the first direction or the second direction). Alternatively, in at least one of the first and second directions, multiple levels for the maximum control amount θmax may be prepared, and the maximum control amount θmax may be set to one of the multiple levels based on the difference between the actual intake valve phase and the stable combustion phase CA(0).

The phase change rate control is executed in consideration of the direction of a change in the valve phase, which is caused by executing the valve timing control based on the engine operating state, by setting the smoothing coefficient used in the setting of the control target value used in the intake valve phase control described with reference to FIGS. 14 to 16, and/or by setting the maximum control amount θmax in each control cycle described with reference to FIGS. 17 and 18. In this way, it is possible to execute the valve timing control based on the engine operating state without reducing the combustion stability.

The phase change rate control similar to the above-described phase change rate control may be executed by variably setting the gain used in the feedback control over the intake valve phase (for example, the control calculation gain used by the required phase change amount calculation unit 6025 in FIG. 12) depending on the direction of a change in the intake valve phase (the first direction or the second direction).

In the embodiment of the invention described above, the intake valve phase setting unit 4010 may be regarded as a "target phase setting unit" according to the invention, the control target valve setting unit 6005 or step S130 (FIG. 16) may be regarded as a "control target value setting unit" according to the invention, and the actuator operation amount setting unit 6000 may be regarded as an "actuator operation amount setting unit" according to the invention. In addition, the phase change direction determination unit 6100 or step group S100 (FIGS. 16 and 18) may be regarded as a "phase change direction determination unit" according to the invention, the phase change rate control unit 6200 (the smoothing coefficient setting unit 6210 and the maximum control amount setting unit 6220) or step group S120 (FIG. 16) and step S140 (FIG. 18) may be regarded as a "change rate control unit" according to the invention.

In the variable valve timing system according to the invention, the configuration of the VVT mechanism that changes the valve timing is not limited to the configuration described in the embodiment of the invention. Any configuration may be employed without limiting the types of actuators.

The embodiment of the invention that has been disclosed in the specification is to be considered in all respects as illustrative and not restrictive. The technical scope of the invention is defined by claims, and all changes which come within the meaning and range of equivalency of the claims are therefore intended to be embraced therein.

What is claimed is:

1. A variable valve timing system that changes opening/closing timing of at least one of an intake valve and an exhaust valve provided in an engine, comprising:

a changing mechanism that changes the opening/closing timing of at least one of the intake valve and the exhaust valve by an amount of change corresponding to an operation amount of an actuator; and configured such that a reference timing at which combustion takes place stably in the engine is present in a middle of a control range in which the opening/closing timing is changed;

a target phase setting unit that sets target opening/closing timing of at least one of the intake valve and the exhaust valve based on an operating state of the engine;

a control target value setting unit that sets a control target value of the opening/closing timing based on the target opening/closing timing set by the target phase setting unit;

an actuator operation amount setting unit that sets an operation amount of the actuator based on a deviation of a current value of the opening/closing timing from the control target value;

a phase change direction determination unit that determines, based on the current value of the opening/closing timing and the target opening/closing timing, whether a direction of a change in the opening/closing timing is a first direction in which the opening/closing timing approaches the reference timing or a second direction in which the opening/closing timing moves away from the reference timing; and a change rate control unit that sets a rate of change in the opening/closing timing to a lower value when the opening/closing timing changes in the second direction and the current value of the opening/closing timing is more delayed than the reference timing than when the opening/closing timing changes in the first direction, and also sets the rate of change in the opening/closing timing to the lower value when the opening/closing timing changes in the second direction and the current value of the opening/closing timing is more advanced than the reference timing than when the opening/closing timing changes in the first direction.

2. The variable valve timing system according to claim 1, wherein the control target value setting unit sets the control target value by smoothing a change in the target opening/closing timing set by the target phase setting unit in a direction of time axis, and the change rate control unit sets a degree, to which the change in the target opening/closing timing is smoothed in the direction of time axis by the control target value setting unit, to a higher value when the opening/closing timing changes in the second direction than when the opening/closing timing changes in the first direction.

3. The variable valve timing system according to claim 1, wherein the actuator operation amount setting unit sets the operation amount of the actuator to a value equal to or smaller than a maximum control amount within a single control cycle based on the deviation of the current value of the opening/closing timing from the control target value, and the change rate control unit sets the maximum control amount to a smaller value when the opening/closing timing changes in the second direction than when the opening/closing timing changes in the first direction.

4. The variable valve timing system according to claim 1, wherein the variable valve timing system executes a feedback control over a phase of the valve of which the opening/closing timing is changed, and the change rate control unit sets a gain used in the feedback control to a smaller value when the opening/closing timing changes in the second direction than when the opening/closing timing changes in the first direction.

5. The variable valve timing system according to claim 1, wherein an electric motor is used as the actuator, the operation amount of the actuator is a rotational speed of the electric motor relative to a rotational speed of a camshaft that drives the valve of which the opening/closing timing is changed, the control range in which the opening/closing timing is changed includes a first region and a second region, the reference timing is set within the first region, the changing mechanism is configured such that a ratio of an amount of change in the opening/closing timing with respect to the operation amount of the actuator is set to a higher value when the opening/closing timing is within the first region than when the opening/closing timing is within the second region, and configured such that the opening/closing timing outside the first region is changed so as to be brought into the first region when a rotational speed of the electric motor is lower than a rotational speed of the camshaft.

6. The variable valve timing system according to claim 1, wherein the reference timing is substantially the same as the target opening/closing timing that is set by the target phase setting unit when the engine is idling.

7. A method for controlling a variable valve timing system that changes opening/closing timing of at least one of an intake valve and an exhaust valve provided in an engine, and that includes a changing mechanism that is configured to change the opening/closing timing of at least one of the intake valve and the exhaust valve by an amount of change corresponding to an operation amount of an actuator; and configured such that a reference timing at which combustion takes place stably in the engine is present in a middle of a control range in which the opening/closing timing is changed, the method comprising:

setting target opening/closing timing of at least one of the intake valve and the exhaust valve based on an operating state of the engine;

setting a control target value of the opening/closing timing based on the target opening/closing timing set based on the operating state of the engine;

setting an operation amount of the actuator based on a deviation of a current value of the opening/closing timing from the control target value;

determining, based on the current value of the opening/closing timing and the target opening/closing timing, whether a direction of a change in the opening/closing timing is a first direction in which the opening/closing timing approaches the reference timing or a second direction in which the opening/closing timing moves away from the reference timing; and setting a rate of change in the opening/closing timing to a lower value when the opening/closing timing changes in the second direction and the current value of the opening/closing timing is more delayed than the reference timing than when the opening/closing timing changes in the first direction, and also sets the rate of change in the opening/closing timing to the lower value when the opening/closing timing changes in the second direction and the current value of the opening/closing timing is more advanced than the reference timing than when the opening/closing timing changes in the first direction.

8. The method according claim 7, wherein the control target value is set by smoothing a change in the target opening/closing timing set based on the operating state of the engine in a direction of time axis, and a degree, to which the change in the target opening/closing timing is smoothed in the direction of time axis, is set to a higher value when the opening/closing timing changes in the second direction than when the opening/closing timing changes in the first direction.

9. The method according to claim 7, wherein the operation amount of the actuator is set to a value equal to or smaller than a maximum control amount within a single control cycle based on the deviation of the current value of the opening/closing timing from the control target value, and the maximum control amount is set to a smaller value when the opening/closing timing changes in the second direction than when the opening/closing timing changes in the first direction.

10. The method according to claim 7, wherein a feedback control is executed over a phase of the valve of which the opening/closing timing is changed, and a gain used in the feedback control is set to a smaller value when the opening/closing timing changes in the second direction than when the opening/closing timing changes in the first direction.

11. The method according to claim 7, wherein an electric motor is used as the actuator, the operation amount of the actuator is a rotational speed of the electric motor relative to a rotational speed of a camshaft that drives the valve of which the opening/closing timing is changed, the control range in which the opening/closing timing is changed includes a first region and a second region, the reference timing is set within the first region, the changing mechanism is configured such that a ratio of an amount of change in the opening/closing timing with respect to the operation amount of the actuator is set to a higher value when the opening/closing timing is within the first region than when the opening/closing timing is within the second region, and configured such that the opening/closing timing outside the first region is changed so as to be brought into the first region when a rotational speed of the electric motor is lower than a rotational speed of the camshaft.

12. The method according to claim 7, wherein the reference timing is substantially the same as the target opening/closing timing that is set when the engine is idling.

* * * * *